US009724615B2

(12) United States Patent
Chan et al.

(10) Patent No.: US 9,724,615 B2
(45) Date of Patent: Aug. 8, 2017

(54) TOY FIGURE WITH RECONFIGURABLE CLOTHING ARTICLE AND OUTPUT GENERATING SYSTEM

(75) Inventors: Patricia Chan, Redondo Beach, CA (US); Kelly Rae Matheny, Hacienda Heights, CA (US); Steven Ryniker, Torrance, CA (US); James P. Zielinski, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 1475 days.

(21) Appl. No.: 13/151,988

(22) Filed: Jun. 2, 2011

(65) Prior Publication Data

US 2012/0142249 A1 Jun. 7, 2012

Related U.S. Application Data

(60) Provisional application No. 61/350,799, filed on Jun. 2, 2010.

(51) Int. Cl.

| | |
|---|---|
| ***A63H 3/00*** | (2006.01) |
| ***A63H 3/28*** | (2006.01) |
| *A63H 3/48* | (2006.01) |
| *A63H 13/00* | (2006.01) |

(52) U.S. Cl.

CPC ..... *A63H 3/28* (2013.01); *A63H 3/48* (2013.01); *A63H 13/00* (2013.01); *A63H 2200/00* (2013.01)

(58) Field of Classification Search

CPC ..... A63H 3/28; A63H 3/52; A63H 33/22
USPC ..... 446/485, 219, 175
See application file for complete search history.

(56) References Cited

U.S. PATENT DOCUMENTS

| | | | | |
|---|---|---|---|---|
| 1,148,540 | A * | 8/1915 | Sancier | 446/321 |
| 1,396,766 | A | 11/1921 | McClelland | |
| 1,784,369 | A * | 12/1930 | Lowenbaum | 2/72 |
| 1,966,986 | A * | 7/1934 | Martin | 446/321 |
| 2,143,294 | A | 1/1939 | Whiting | |
| 2,195,127 | A | 3/1940 | Brucker | |
| 2,325,750 | A | 8/1943 | De Vries | |
| 2,380,175 | A * | 7/1945 | Hawkey | 135/16 |
| 2,669,802 | A | 2/1954 | Olivier | |
| 2,688,689 | A | 9/1954 | Christopher | |
| 2,697,224 | A * | 12/1954 | Aidenland | 2/71 |
| 2,737,661 | A | 3/1956 | Carney | |
| RE25,678 | E | 11/1964 | Risler | |
| 3,186,125 | A | 6/1965 | Orel | |
| 3,205,350 | A | 9/1965 | Roszkowski et al. | |
| 3,359,570 | A | 12/1967 | Rodgers | |
| 3,531,891 | A | 10/1970 | Goldfarb et al. | |

(Continued)

FOREIGN PATENT DOCUMENTS

| | | |
|---|---|---|
| EP | 0893150 B1 | 2/2004 |
| ES | 2020403 A6 | 8/1991 |

(Continued)

*Primary Examiner* — Aarti B Berdichevsky
*Assistant Examiner* — Urszula M Cegielnik
(74) *Attorney, Agent, or Firm* — Edell, Shapiro & Finnan, LLC

(57) ABSTRACT

A toy doll with a reconfigurable clothing article is disclosed. In particular, a toy doll with a reconfigurable clothing article and an electronic system that generates outputs is disclosed. In one embodiment, the clothing article can be reconfigured relative to the body of the toy doll. In one embodiment, the body of the toy doll includes a display portion that can be used to generate various visual displays.

17 Claims, 29 Drawing Sheets

(56) References Cited

U.S. PATENT DOCUMENTS 3,707,055 A 12/1972 Pearce
3,782,027 A 1/1974 Goldfarb et al.
3,811,220 A * 5/1974 Glass et al. ..... 446/321
3,851,419 A 12/1974 Kaelin
3,939,604 A 2/1976 Nishizawa
4,030,239 A 6/1977 White et al.
4,107,873 A 8/1978 Bauer
4,136,483 A 1/1979 Shackelford et al.
4,168,592 A 9/1979 Merino
4,282,680 A 8/1981 Zaruba
4,336,665 A 6/1982 Moreau
4,380,833 A 4/1983 Peters
4,414,774 A 11/1983 Fogarty et al.
4,464,861 A 8/1984 Fogarty et al.
4,521,205 A 6/1985 Spector
4,568,304 A 2/1986 Santa Maria
4,571,206 A 2/1986 Mayer et al.
4,623,318 A 11/1986 Tsiknopoulos et al.
4,637,798 A 1/1987 Maiden-Nesset
4,639,233 A 1/1987 Brassfield
4,695,264 A 9/1987 McLeod, Jr.
4,721,489 A 1/1988 Galoob
4,723,931 A 2/1988 Allen et al.
4,858,079 A 8/1989 Ohashi
4,867,729 A 9/1989 Weinman et al.
4,878,873 A * 11/1989 Yamaguchi et al. ..... 446/321
4,921,459 A 5/1990 Cook et al.
5,037,346 A 8/1991 Cimock
5,046,986 A 9/1991 Wood et al.
5,091,833 A * 2/1992 Paniaguas et al. ..... 362/191
5,094,621 A 3/1992 Friedel
5,114,376 A 5/1992 Copley et al.
5,118,319 A 6/1992 Smith et al.
5,149,289 A 9/1992 Edwards et al.
5,186,673 A 2/1993 Fogarty et al.
5,209,694 A 5/1993 Utt, Jr.
5,277,644 A 1/1994 Osborne et al.
5,299,968 A 4/1994 Bennett
5,310,378 A 5/1994 Shannon
5,324,201 A 6/1994 Friedel
5,324,224 A 6/1994 Anderson et al.
5,326,300 A * 7/1994 Sonders ..... 446/74
5,328,400 A 7/1994 Bass
5,328,401 A 7/1994 DeMars
5,359,506 A * 10/1994 Koleno ..... 362/248
5,417,606 A 5/1995 Kimura
5,433,643 A * 7/1995 Pratt ..... 446/73
5,439,407 A 8/1995 Friedel
5,466,181 A * 11/1995 Bennett et al. ..... 446/297
5,480,337 A * 1/1996 Baker ..... 446/100
5,495,151 A * 2/1996 Lu ..... 318/4
5,525,086 A * 6/1996 Gentile et al. ..... 446/41
5,545,072 A * 8/1996 Arad et al. ..... 446/268
5,580,296 A 12/1996 Chow
5,588,898 A 12/1996 Ooba
5,607,336 A * 3/1997 Lebensfeld et al. ..... 446/297
5,668,333 A 9/1997 Horton et al.
5,672,090 A 9/1997 Liu
5,730,638 A 3/1998 Ward
5,791,965 A 8/1998 Kim
5,803,787 A 9/1998 Kulchyski
5,868,598 A 2/1999 Dinovo
5,894,600 A 4/1999 Chenefront
5,902,166 A 5/1999 Robb
6,053,795 A 4/2000 Whitney et al.
6,053,798 A 4/2000 Tang
6,142,849 A 11/2000 Horton et al.
6,164,972 A * 12/2000 Winslow ..... 434/219
6,165,037 A 12/2000 Van Zant
6,165,038 A 12/2000 Muller
6,190,229 B1 2/2001 Nadel et al.
6,224,234 B1 5/2001 Demmery
6,227,930 B1 5/2001 Norman et al.
6,253,058 B1 * 6/2001 Murasaki et al. ..... 434/308
6,261,149 B1 7/2001 Moore
6,322,421 B1 11/2001 Hou
6,364,509 B1 4/2002 Johnson, III
6,371,825 B1 * 4/2002 Foreman ..... 446/268
6,371,827 B1 4/2002 Chou
6,386,942 B1 5/2002 Tang
6,425,796 B1 7/2002 Gaynor et al.
6,428,321 B1 * 8/2002 Jurmain et al. ..... 434/238
6,431,729 B1 8/2002 Chen
6,431,937 B1 8/2002 Lau et al.
6,434,769 B1 * 8/2002 Koenig ..... 5/636
6,514,118 B1 2/2003 Bart et al.
6,554,679 B1 * 4/2003 Shackelford et al. ..... 446/268
6,557,175 B2 * 5/2003 Greenblatt ..... 2/69
6,558,022 B2 5/2003 Kawahara
6,558,224 B2 5/2003 Chan
6,568,986 B2 5/2003 Kobayashi
6,607,388 B2 8/2003 Cogliano
6,648,721 B2 11/2003 Rehkemper et al.
6,648,725 B2 11/2003 Chan
6,663,393 B1 12/2003 Ghaly
6,682,387 B2 1/2004 Choi
6,719,604 B2 * 4/2004 Chan ..... 446/297
6,741,042 B1 5/2004 Tang
6,755,713 B1 * 6/2004 Weber et al. ..... 446/143
6,790,117 B2 9/2004 Ruiz Gonzalez
6,802,755 B2 10/2004 Walker et al.
6,802,757 B1 * 10/2004 Sejnowski ..... 446/227
6,851,999 B2 2/2005 Fong
6,882,824 B2 4/2005 Wood
6,948,999 B2 9/2005 Chan
6,955,581 B1 10/2005 Liu
6,962,517 B2 11/2005 Murray
6,966,666 B2 11/2005 Liu
6,997,772 B2 2/2006 Fong
6,997,773 B1 2/2006 Dubois et al.
7,014,565 B2 3/2006 Chang
7,018,265 B2 3/2006 Ghaly
7,134,765 B2 * 11/2006 Torgerson ..... 362/186
7,165,869 B2 1/2007 Chernick et al.
7,431,630 B2 10/2008 Dubois et al.
7,448,932 B2 11/2008 Buckley et al.
7,713,105 B2 * 5/2010 Barthold ..... 446/308
7,808,385 B2 * 10/2010 Zheng ..... 340/572.1
7,982,613 B2 * 7/2011 Zheng ..... 340/572.1
8,157,611 B2 * 4/2012 Zheng ..... 446/268
8,282,437 B2 * 10/2012 Norman et al. ..... 446/37
2002/0146961 A1 * 10/2002 Perez Cuevas ..... 446/484
2003/0111374 A1 6/2003 Mendoza
2004/0198155 A1 10/2004 Cooper
2005/0009441 A1 * 1/2005 Thomas ..... 446/268
2005/0153621 A1 7/2005 Gillmour-Bryant et al.
2005/0164598 A1 7/2005 Kelsey
2005/0191936 A1 9/2005 Marine et al.
2005/0197041 A1 9/2005 Fink
2006/0084362 A1 4/2006 Ghaly
2006/0105671 A1 5/2006 Connolly
2006/0194508 A1 8/2006 Johnson et al.
2006/0234599 A1 10/2006 Mo et al.
2006/0258256 A1 11/2006 Isenberg
2006/0270307 A1 11/2006 Montalvo et al.
2006/0292963 A1 12/2006 Sun et al.
2007/0031809 A1 2/2007 Wei
2007/0212974 A1 9/2007 Brewer
2007/0283604 A1 * 12/2007 Kaoh ..... 40/552
2008/0305710 A1 12/2008 Roberts
2009/0030808 A1 1/2009 Park
2009/0130943 A1 * 5/2009 Norman et al. ..... 446/37
2010/0093254 A1 * 4/2010 Jung ..... 446/376
2011/0056001 A1 * 3/2011 Missett et al. ..... 2/244

FOREIGN PATENT DOCUMENTS

GB 2221626 A 2/1990
GB 2277881 A 11/1994
JP 9-187575 A 7/1997
JP 11-76628 A 3/1999
JP 2000-262760 A 9/2000
JP 2005-27959 A 3/2005
JP 2007-61292 A 3/2007

(56) References Cited

FOREIGN PATENT DOCUMENTS

| | | | | |
|---|---|---|---|---|
| JP | 2008-35275 | A | 2/2008 | |
| JP | 2008-167880 | A | 7/2008 | |
| WO | 93/05857 | A1 | 4/1993 | |
| WO | 93/23128 | A1 | 11/1993 | |
| WO | 00/10669 | A1 | 3/2000 | |
| WO | WO 2007010264 | A2 * | 1/2007 | ..... A63H 3/00 |

* cited by examiner

TOY FIGURE WITH RECONFIGURABLE CLOTHING ARTICLE AND OUTPUT GENERATING SYSTEM

CROSS-REFERENCE TO RELATED APPLICATION

This application claims priority to and the benefit of U.S. Provisional Patent Application No. 61/350,799, filed Jun. 2, 2010, entitled "Toy Figure with Reconfigurable Clothing Article and Output Generating System," the entire disclosure of which is incorporated herein by reference in its entirety.

FIELD OF THE INVENTION

This invention relates generally to a toy figure or doll with a reconfigurable clothing article, and in particular, to a toy figure or doll with a reconfigurable clothing article and an electronic system that generates outputs.

BACKGROUND OF THE INVENTION

Many conventional toy dolls include an article of clothing. However, conventional toy dolls often lack the ability for transforming or reconfiguring the article of clothing. In addition, conventional toy dolls lack the ability to generate outputs. Moreover, conventional toy dolls lack the ability to generate visual displays, particularly from a body of the toy doll.

Thus, there is a need for a toy figure with a clothing article that can be easily transformed or reconfigured. In addition, there is a need for a toy figure with an output generating system that generates outputs from the body of the toy figure. Also, there is a need for such a toy figure that has the ability to create illusions or appearance of the movement of light relative to the body of the toy figure.

SUMMARY OF THE INVENTION

The present invention relates to a toy doll that has a reconfigurable clothing article. The clothing article can be reconfigured relative to the toy doll and placed in different configurations. A different portion of the clothing article is visible and exposed in each of the different configurations, thereby creating a different appearance for the toy doll. In other words, the toy doll can be transformed between configurations, such as those resembling a formal dress and a party gown.

The present invention also relates to a toy doll that has an electronic system with an output generating system. The output generating system includes an audible output generating component or device that can generate audible outputs, such as music, sound effects, and/or speech. The output generating system also includes several visual output generating components or devices, such as LEDs. The electronic system includes a microcontroller or controller that is used to control the illumination of the LEDs. The LEDs can be different colors and can be separated from each other so that each LED or related LEDs, such as by color, can be illuminated in a coordinated manner.

The toy doll includes a display portion that can be revealed by the reconfiguration of the clothing article. In one embodiment, the display portion is formed on the torso portion of the toy doll. The display portion can include transparent or translucent sections or areas through which light from the internally located LEDs can be emitted. The toy doll includes a guide structure that forms or creates different areas or chambers that can be illuminated by different LEDs. For example, one area or chamber can be illuminated by one or more LEDs of a first color and a second area or chamber can be illuminated by one or more LEDs of a second color. Alternatively, another area or chamber can be illuminated by a bi-color LED. The locations of the LEDs can be used to create the appearance of movement of the lights along the body of the toy figure.

In one embodiment, the invention relates to a reconfigurable doll that comprises a body having a torso portion, an output generating system, and an actuator coupled to the body and connected to the output generating system, and a clothing article coupled to the body, the clothing article being movable between a first configuration and a second configuration relative to the body, the clothing article in the first configuration covering the torso portion, and when the clothing article is moved to the second configuration, the clothing article can be engaged by a user to contact the actuator to cause an output to be generated by the output generating system.

In one embodiment, the output includes a visual output and an audible output.

In one embodiment, the output generating system includes at least one light emitting device.

In one embodiment, the torso portion includes a translucent portion and the output generating system includes a light emitting device, and the light from the light emitting device is visible through the translucent portion.

In one embodiment, the torso portion includes a front surface with a first translucent portion and a second translucent portion, the output generating system includes a first light emitting device and a second light emitting device, light from the first light emitting device passes through the first translucent portion, and light from the second light emitting device passes through the second translucent portion.

In one embodiment, the body includes a guide element that defines a first chamber and a second chamber separate from the first chamber, the first chamber is proximate to the first translucent portion, the second chamber is proximate to the second translucent portion, the first light emitting device is located proximate to the first chamber, and the second light emitting device is located proximate to the second chamber.

In one embodiment, the first light emitting device and the second light emitting device can be illuminated at different times.

In one embodiment, the clothing article has an upper portion and a lower portion coupled to the upper portion, the upper portion covers the torso portion when the clothing article is in its first configuration, and the upper portion is folded down proximate to the lower portion when the clothing article is in its second configuration.

In one embodiment, the clothing article has a first surface and a second surface opposite to the first surface, the first surface is oriented outwardly when the clothing article is in its first configuration, and the second surface is oriented outwardly when the clothing article is in its second configuration.

In one embodiment, the clothing article is rotated approximately 180 degrees about the body to move from the first configuration to the second configuration.

In one embodiment, the clothing article includes an engagement member coupled thereto, the engagement member is proximate to and configured to contact the actuator when the clothing article is placed in its second configuration.

In another embodiment, the doll comprises a body defining an interior region, the body including a first light emitting device and a second light emitting device, each of the light emitting devices is located in the interior region, the body defining a first translucent portion and a second translucent portion separate from the first translucent portion such that light from the first light emitting device passes through the first translucent portion only and light from the second light emitting device passes through the second translucent portion only.

In one embodiment, a clothing article is coupled to the body, the clothing article being movable between a first configuration and a second configuration, the clothing article in its first configuration covers the translucent portions, and the clothing article in its second configuration is spaced apart from the translucent portions.

In one embodiment, the body has a torso with a front portion, the translucent portions are formed in the front portion of the torso, and the clothing article covers the torso front portion in the first configuration.

In one embodiment, the body includes an electronic system that includes the light emitting devices and actuator coupled to the body, the clothing article is configured to engage the actuator when the clothing article is in its second configuration, and the actuation of the actuator results in illumination of the light emitting devices.

In one embodiment, the body includes a first chamber and a second chamber having a different size than the first chamber, the first chamber is located so as to direct light from the first light emitting device through the first translucent portion, and the second chamber is located so as to direct light from the second light emitting device through the second translucent portion.

In another embodiment, a doll with a reconfigurable clothing article comprises a doll body including a torso portion, a leg portion, and an actuator, the torso portion including a translucent portion, the doll body defining an interior region in which a light emitting device is located, the light emitting device being positioned so that light from the light emitting device passes through the translucent portion, and a clothing article coupled to the doll body, the clothing article being reconfigurable between a first configuration and a second configuration, the clothing article in its first configuration covers the translucent portion, and the clothing article in its second configuration is configured to engage the actuator to actuate the light emitting device.

In one embodiment, the clothing article in the second configuration is spaced apart from the translucent portion so that the translucent portion is visible.

In one embodiment, the clothing article has a first side and a second side opposite to the first side, the first side is exposed when the clothing article is in its first configuration, and the second side is exposed when the clothing article is in its second configuration, the clothing article is moved approximately 180 degrees relative to the torso portion when the clothing article moves between its first configuration and its second configuration.

In one embodiment, the translucent portion is a first translucent portion and the light emitting device is a first light emitting device, and the doll body includes a second translucent portion and a second light emitting device, the first light emitting device is located so that light from the first light emitting device only passes through the first translucent portion, and the second light emitting device is located so that light from the second light emitting device only passes through the second translucent portion.

BRIEF DESCRIPTION OF THE DRAWINGS

Like reference numerals have been used to identify like elements throughout this disclosure.

DETAILED DESCRIPTION OF THE INVENTION

The term "toy doll" is used to refer to a figure or character with which a child can play. The terms "area," "chamber," and "receptacle" may be used interchangeably herein to refer to a space defined by one or more structures.

Figure 2:
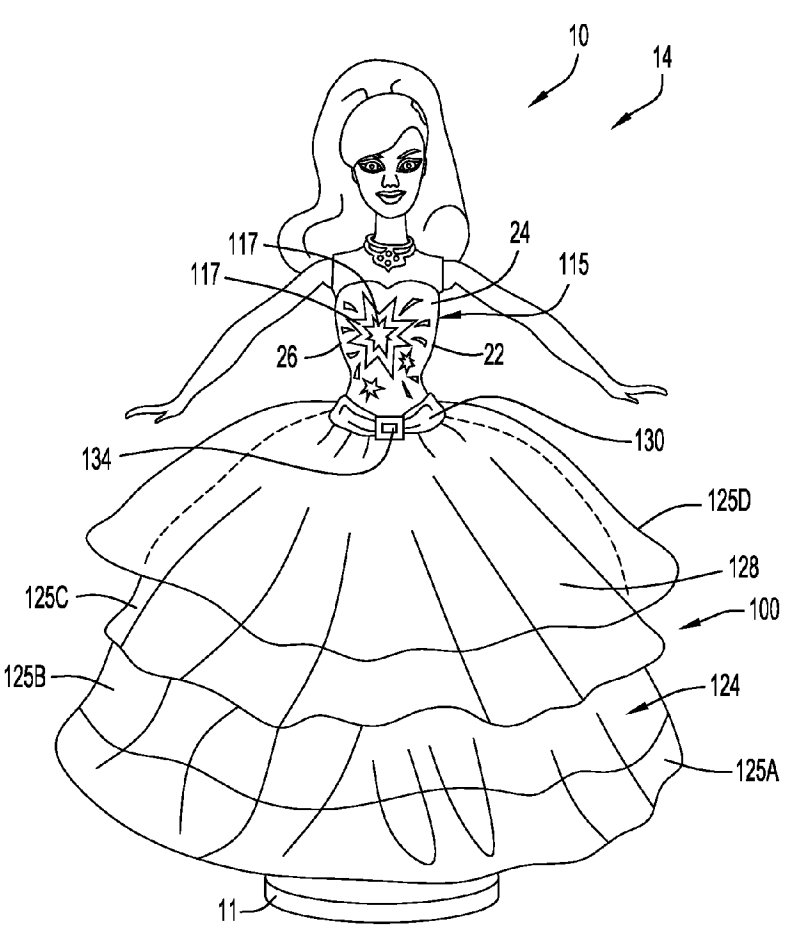
FIG. 2 illustrates a front view of the doll and clothing article illustrated in FIG. 1 in a different configuration.
Figure 1:
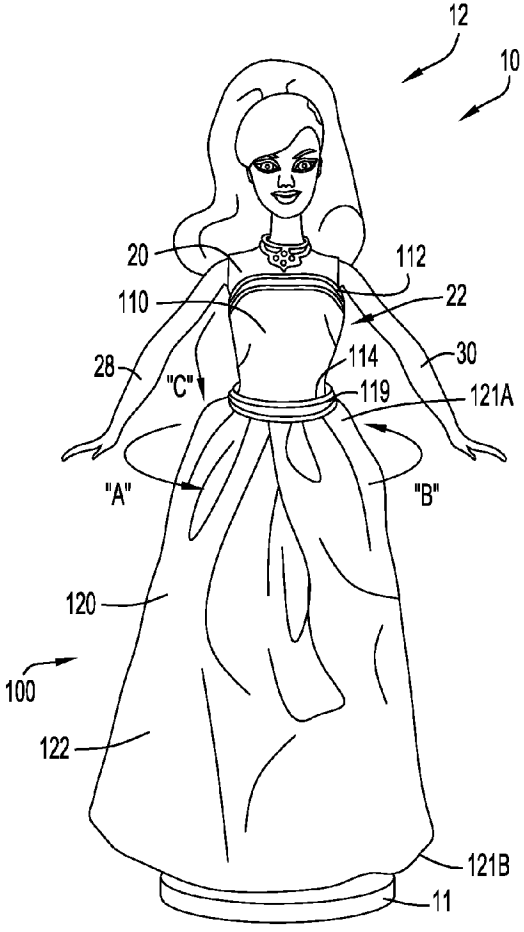
FIG. 1 illustrates a front view of an embodiment of a toy figure or doll with a clothing article in a configuration according to the present invention.

Referring to FIGS. 1 and 2, an embodiment of a doll according to the present invention is illustrated. In this embodiment, the doll 10 is reconfigurable. In FIG. 1, the doll 10 is illustrated in a configuration 12 in which the doll 10 has an article of clothing or clothing article 100 resembling a dress, such as a formal dress. The clothing article 100 can be manipulated relative to the doll 10 to create a different appearance. Referring to FIG. 2, the doll 10 and, in particular, the clothing article 100 is placed or disposed in a different configuration 14 creating a different overall appearance. In this configuration 14, the dress has a gown-like appearance. In addition, the extent to which the clothing article 100 covers the body of the doll 10 varies between the configurations 12 and 14.

In this embodiment, the doll 10 includes a body 20 with a torso 22 having a front side 24 on which a bodice 26 is formed. The doll 10 includes arms 28 and 30 which are movably coupled to the torso 22. The doll 10 also includes legs (not shown in FIG. 1 or 2) that can be coupled to a stand 11 to support the doll 10 in a desired position and orientation.

In one embodiment, torso 22 is formed of a clear Acrylonitrile Butadiene Styrene (ABS) material. A graphic configuration, such as the shape of a star, is cut out of the torso 22 in a concentric nested manner.

As described in greater detail below, the doll 10 includes a display portion 115 that is capable of generating and displaying light. The light in the display portion 115 is generated by using multiple LEDs or light sources that are located in the interior of the body 20 of the doll 10. The light generated by the LEDs is emitted through openings in the torso 22, which can be covered by a solid, frosted plastic wall, in one embodiment. In FIG. 2, the internal LEDs are illuminated and the light therefrom emit from translucent areas 117 formed in the torso 22.

The color, movement, and intensity of the light can vary, thereby creating the appearance that the light is animated. The doll 10 also includes an audible output generator through which sounds and music can be generated. The animation of the light can be timed so that it appears to be coordinated with the audible outputs.

Referring to FIG. 1, the clothing article 100 includes an upper portion 110 and a lower portion 120. The upper portion 110 has an upper end 112 and a lower end 114 that is located proximate to a waist portion 119. The upper portion 110 wraps around the torso 22 of the doll 10 and includes two free ends 116 and 118 (see FIG. 3) that can be coupled together on the rear surface of the doll 10 using coupling mechanisms such as hook and loop fasteners. The coupling mechanisms maintain the ends 116 and 118 together which results in the clothing article 110 being wrapped around and covering the torso portion 22.

As shown in FIG. 1, the lower portion 120 of the clothing article 100 has an upper end 121A proximate to the waist portion 119 and a lower end 121B opposite to the upper end 121A. The lower portion 120 of the clothing article 100 has a surface 122 that forms the outer or visible exterior of the clothing article 100 in configuration 12. The surface 122 has a shiny, smooth texture as shown.

Referring to FIG. 2, when the clothing article 100 is reconfigured, as described below, surface 124 of the clothing article 100, which is opposite to surface 122, is exposed and visible. As shown, in this embodiment, surface 124 has several different layers 125A, 125B, 125C, and 125D, each of which is coupled proximate to the waist portion 119 using stitching or other coupling technique or mechanism. Some of the layers can be see through and one or more layers may include a light emitting device, such as an LED 128 (as shown in FIG. 2). In other embodiments, the quantity of layers forming the surface 124 can vary.

Referring back to FIG. 1, when a child or other user desires to reconfigure the doll 10, the coupling mechanisms of the upper portion 110 on the rear surface of the doll 10 are decoupled. The clothing article 100, including the upper portion 110 and the lower portion 120, is rotated approximately 180 degrees around the doll body 20 along the directions of arrows "A" and "B." The ends of the lower portion 120 on the rear side of the doll 10 are separated, thereby opening up the clothing article 100 and exposing surface 124 (see FIG. 2). After the clothing article 100 has been rotated and opened, the upper portion 110 is folded downwardly along the direction of arrow "C" on the rear side of the doll body 20. The coupling mechanisms on the rear surface of the doll body 20 are subsequently engaged with each other and the clothing article 100 is retained in the configuration illustrated in FIG. 2.

In one embodiment, the audible output generated by the doll 10 varies depending on the position and orientation of the clothing article 100 and the configuration of the doll 10. For example, the doll 10 may generate different audible outputs, such as songs, based on the position of the clothing article 100. In FIG. 1, the clothing article 100 is in a formal configuration in which the article 100 resembles a formal dress. The song generated by the audible output generator may be a demure or reserved song, which corresponds to the clothing article 100 resembling formal apparel. In FIG. 2, the clothing article 100 is in a less formal configuration than that shown in FIG. 1. In this configuration, the clothing article 100 resembles a party gown. Accordingly, the song generated by the audible output generator may be a funkier or more upbeat song, corresponding to the configuration and appearance of the clothing article 100.

A song that is being played by the doll 10 is interrupted when the clothing article 100 is reconfigured or repositioned on the doll 10. For example, if the clothing article 100 is in configuration 12 illustrated in FIG. 1 when a song corresponding to that configuration 12 is being played, the song is interrupted when the clothing article 100 is reconfigured to configuration 14 illustrated in FIG. 2. At that point, when the clothing article 100 is moved to configuration 14, the song corresponding to that configuration 14 is then played until it ends or is interrupted. Similarly, the doll 10 may be programmed so that it has a first light show corresponding to the clothing article 100 being in configuration 12 and a second light show corresponding to the clothing article 100 being in configuration 14. As the clothing article 100 transitions between configuration 12 and configuration 14, the currently displayed light show is interrupted as the clothing article 100 is positioned in the other configuration.

Figure 3:
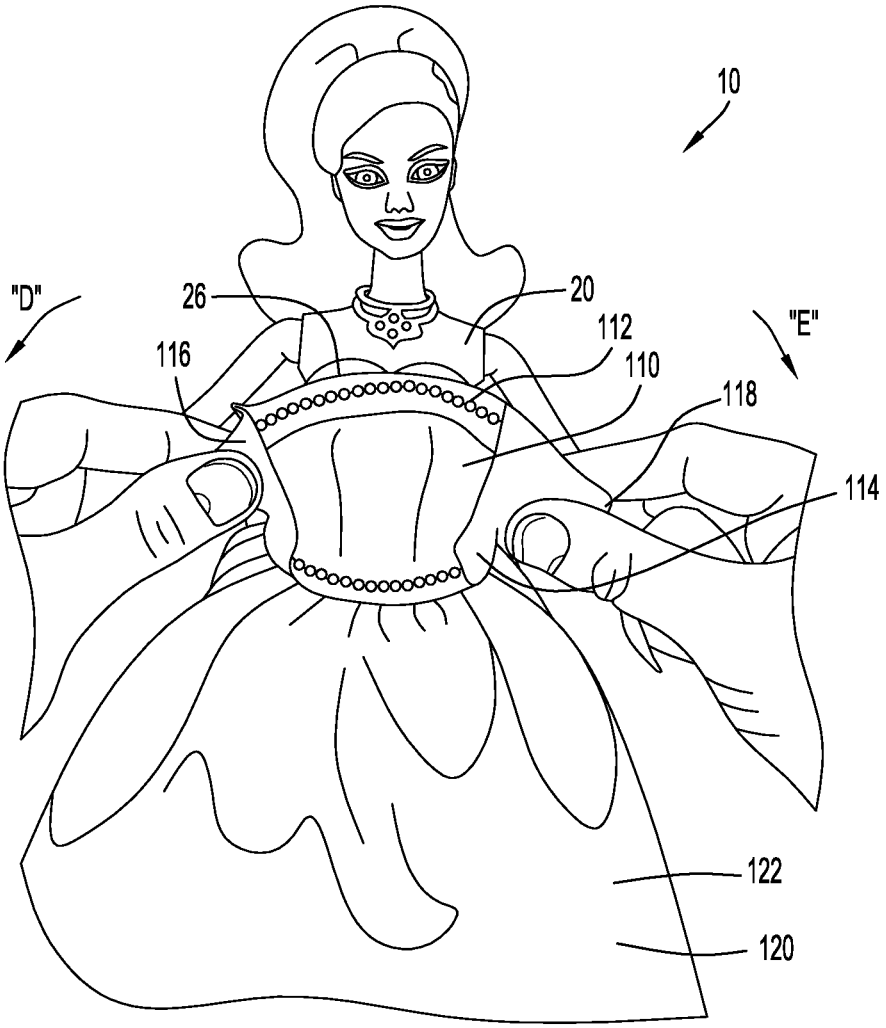
FIGS. 3-7 illustrates front views of a portion of the doll and clothing article illustrated in FIG. 1 in different intermediate configurations in the transformation between the configurations illustrated in FIGS. 1 and 2.

Referring to FIGS. 3-7, the reconfiguration or transformation process is illustrated in greater detail. In FIG. 3, the ends 116 and 118 of the upper portion 110 are illustrated as being decoupled from each other. When the coupling mechanisms on ends 116 and 118 are decoupled, the ends 116 and 118 can be moved along the directions of arrows "D" and "E," respectively.

Figure 4:
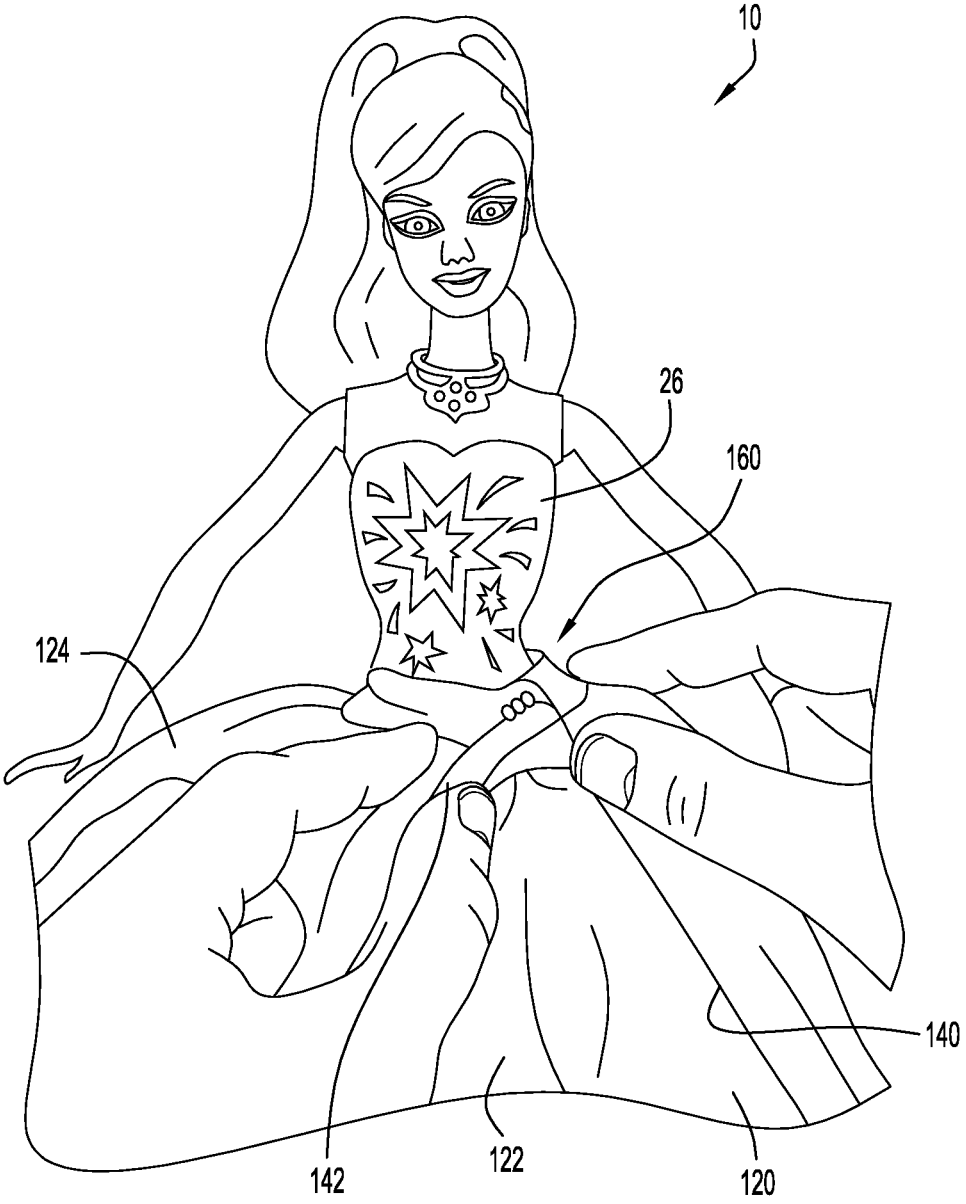

When the doll 10 is in configuration 12 (shown in FIG. 1), the lower portion 120 has opposite ends that are releasably coupled to each other via coupling mechanisms, such as hook and loop material fasteners. Referring to FIG. 4, the upper portion 110 has been folded downward and the opposite ends 140 and 142 of the lower portion 120 are brought proximate to each other. As a result of the decoupling and subsequent moving of the ends 140 and 142, surface 122 which is displayed in configuration 12 is covered up and surface 124 is exposed. In other words, the lower portion 120 is turned inside out to expose surface 124 instead of surface 122.

Figure 5:
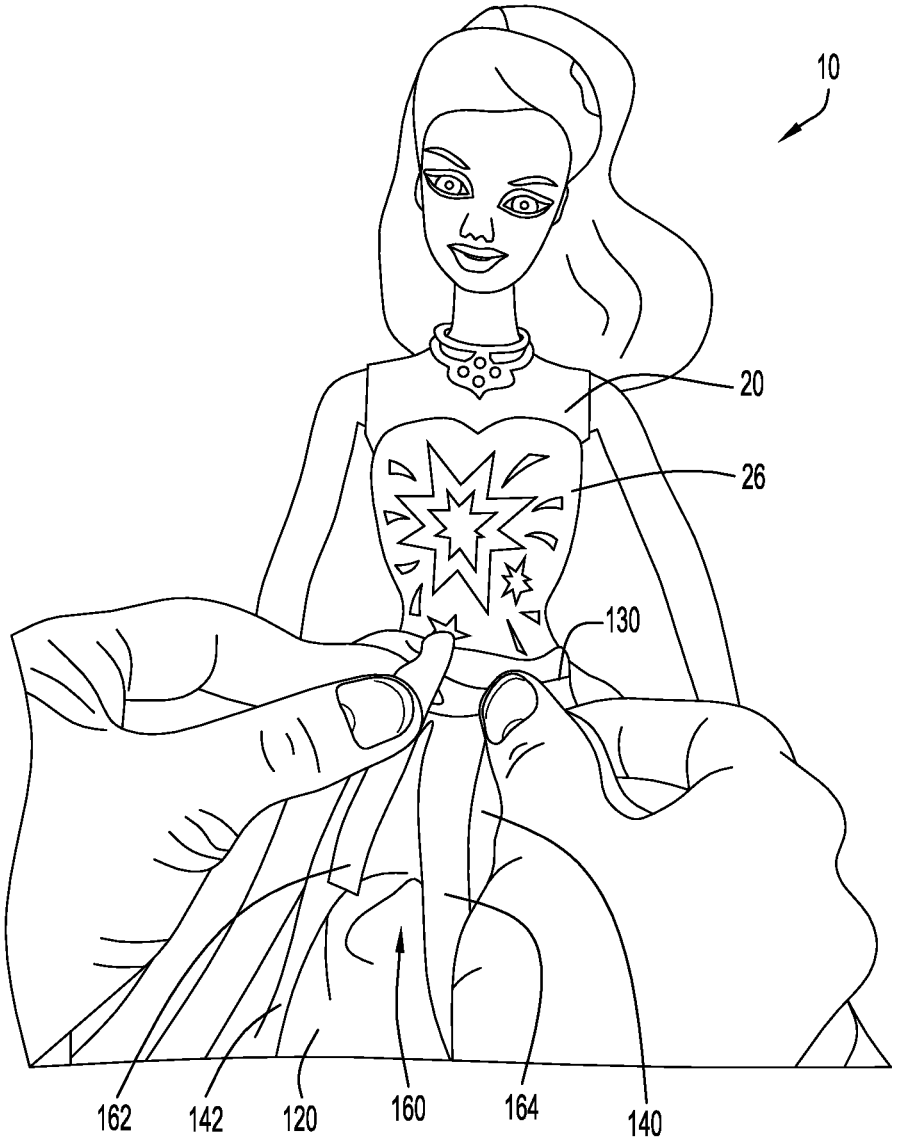

Referring to FIGS. 4 and 5, a coupling mechanism 160 can be used to maintain the ends 140 and 142 coupled to each other. In this embodiment, the coupling mechanism 160 includes a hook portion 162 coupled to side edge 142, such as by sewing or other technique, and a loop portion 164 coupled to side edge 140, such as by sewing or other technique. The hook and loop portions 162 and 164 can be engaged with each other to couple the side edges or ends 140 and 142 together. When the ends 140 and 142 are coupled together, surface 122 is located on the interior of the lower portion 120 and surface 124 is exposed.

Figure 6:
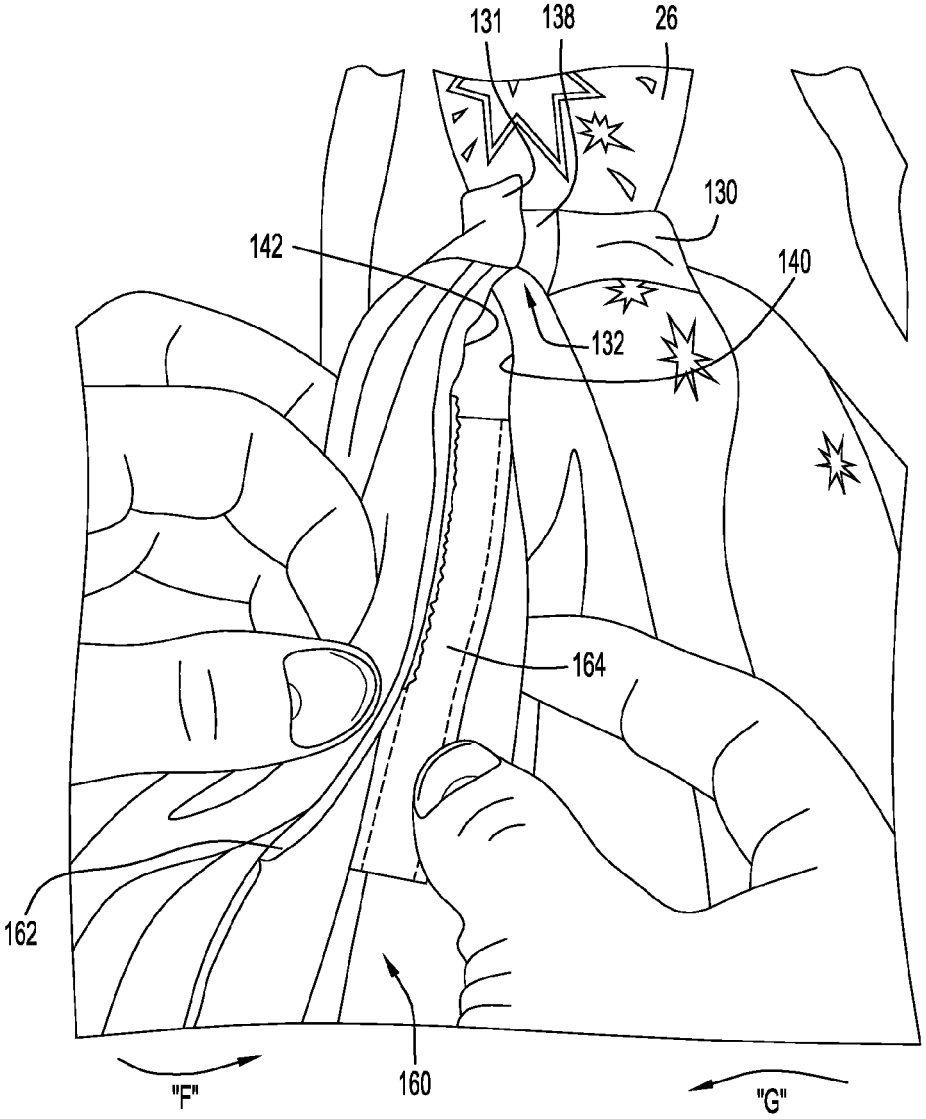

Referring to FIG. 6, the ends 142 and 140 have been moved along the directions of arrows "F" and "G" and the coupling mechanisms or hook and loop portions 162 and 164 engaged with each other as shown. In addition, the clothing article 100 includes a band or waist portion 130 (also shown in FIGS. 2 and 5) that has opposite ends 131 and 132 releasably coupled to each other by coupling mechanisms, such as coupling mechanism 138.

Figure 7:
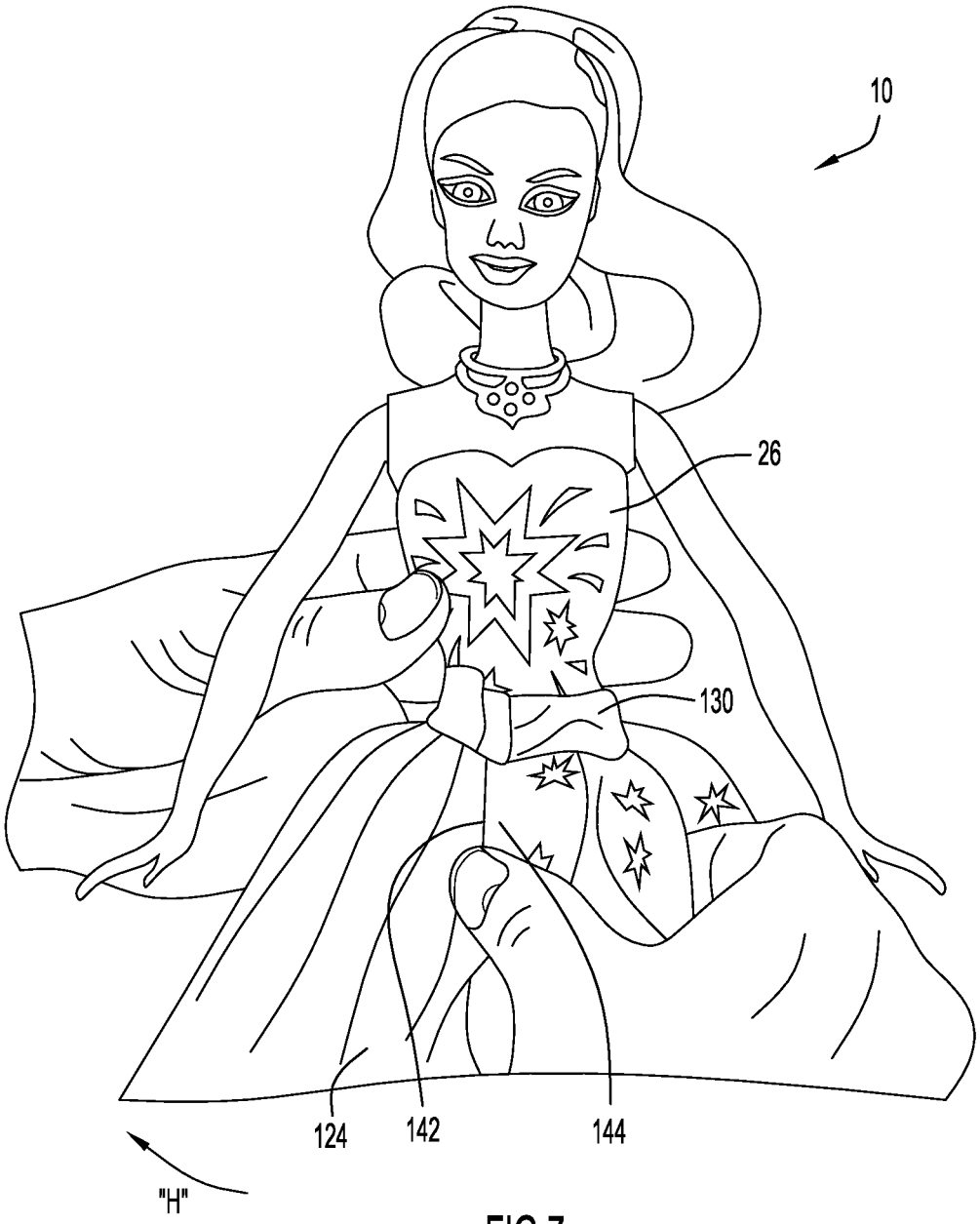

Referring to FIG. 7, the ends 142 and 144 have been coupled together and the clothing article 100 can be rotated approximately 180 degrees about the doll body 22 along the direction of arrow "H." By rotating the clothing article 100 along arrow "H," the coupled ends are located on the rear surface of the doll 10 and are not visible from the front.

In some embodiments, the clothing article 100 is coupled to a belt about the doll body 22. The clothing article 100 may be coupled to the belt by one or more fabric loops coupled to one or more notches in the belt or, additionally or alternatively, looped through perforations the belt. The belt may aid in rotating the clothing article 100 about the doll body 22.

Figure 8:
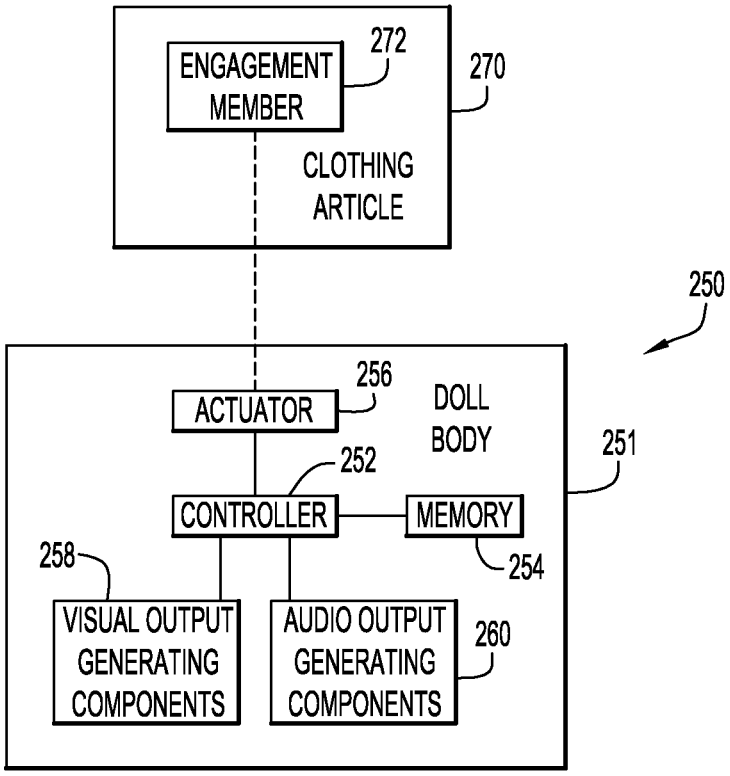
FIG. 8 illustrates a schematic block diagram of some components of the electronic system of the doll illustrated in FIG. 1.

Referring to FIG. 8, a schematic block diagram of some components of the electronic system of an embodiment of a doll according to the invention is illustrated. In this embodiment, a doll 250 has a doll body 251 in which a controller 252 is connected to a memory 254 and to an actuator 256 that can be engaged by an engagement member 272. In this embodiment, the engagement member 272 is coupled to a clothing article 270 mounted to the doll body 251. The engagement member 272 is not in continuous contact with the actuator 256, but can be moved into contact with the actuator 256 by a user. The system also includes visual output generating components 258, such as light emitting diodes (LEDs), that can be placed at different locations on the body of the doll 250, as described below. In addition, the system also includes an audible output generating component 260, such as a speaker or transducer, that generates audible outputs, such as music and sound effects. In an alternative embodiment, one or more visual output generating components can be on clothing article 270 as well.

In one implementation, when the engagement member 272 is moved into contact with the actuator 256, the system is activated to generate an audible output via component 260 that includes music. At the same time, the system generates visual outputs via components 258 that are timed to be in synch with the music being generated. In one example, certain ones of the components 258 are illuminated in synch with the beat of the music being generated by component 260. In another example, the components 258 are different colored LEDs and the LEDs of a particular color are illuminated at the same time to provide a visual show of light that changes colors to the music being generated. In another example, at the end of the generated music, sound effects resembling the applause of a crowd are generated.

Figure 9:
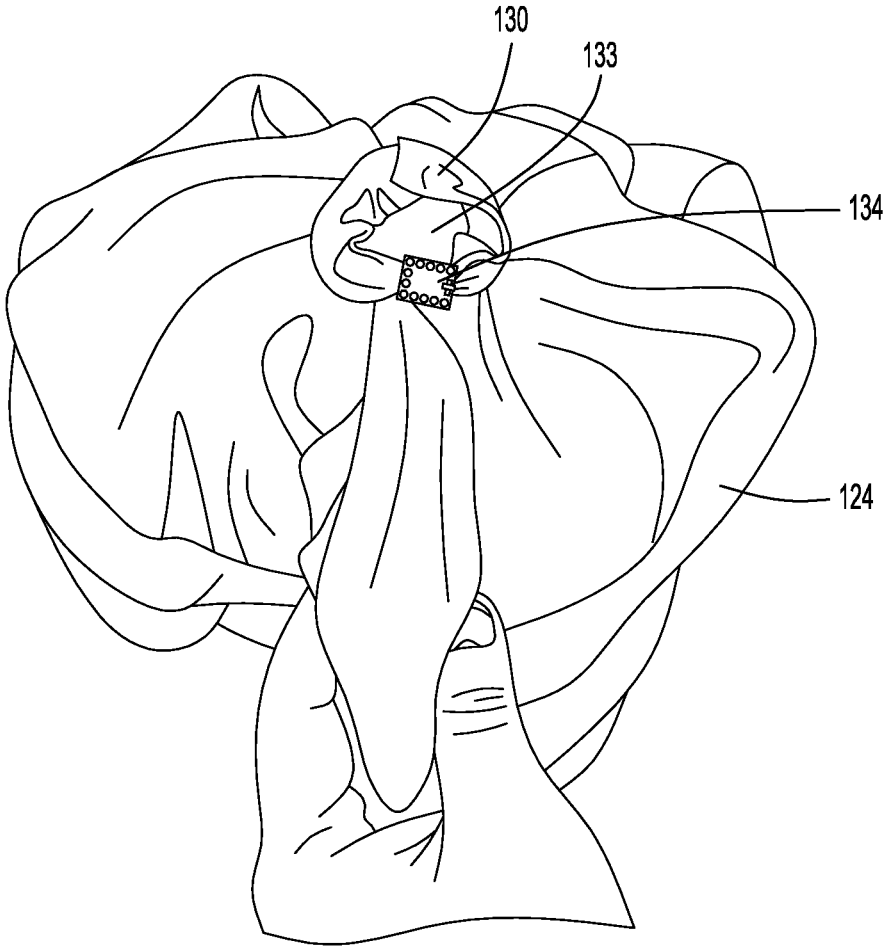
FIG. 9 illustrates a top view of the clothing article illustrated in FIG. 1.

Referring to FIG. 9, a top perspective view of clothing article 100 is illustrated. The clothing article 100 is in configuration corresponding to configuration 14 illustrated in FIG. 2. In this configuration, the clothing article 100 has been reconfigured so that surface 124 is exposed. The waist portion 130 of the clothing article 100 defines an interior region or receiving area 133 in which the waist of the doll 10 is located when the clothing article 100 is placed on the doll body 20.

Coupled to the clothing article 100 is an engagement member 134 (also shown in FIG. 2). In this embodiment, engagement member 134 is a molded plastic article that is coupled to the waist portion 130 of the clothing article 100. The engagement member 134 is located so that it is exposed and visible when the clothing article 100 is in configuration 14 and hidden when the clothing article 100 is in configuration 12. The engagement member 134 may have an opening formed therein that facilitates the coupling or mounting of the engagement member 134 to the waist portion 130.

Figure 10:
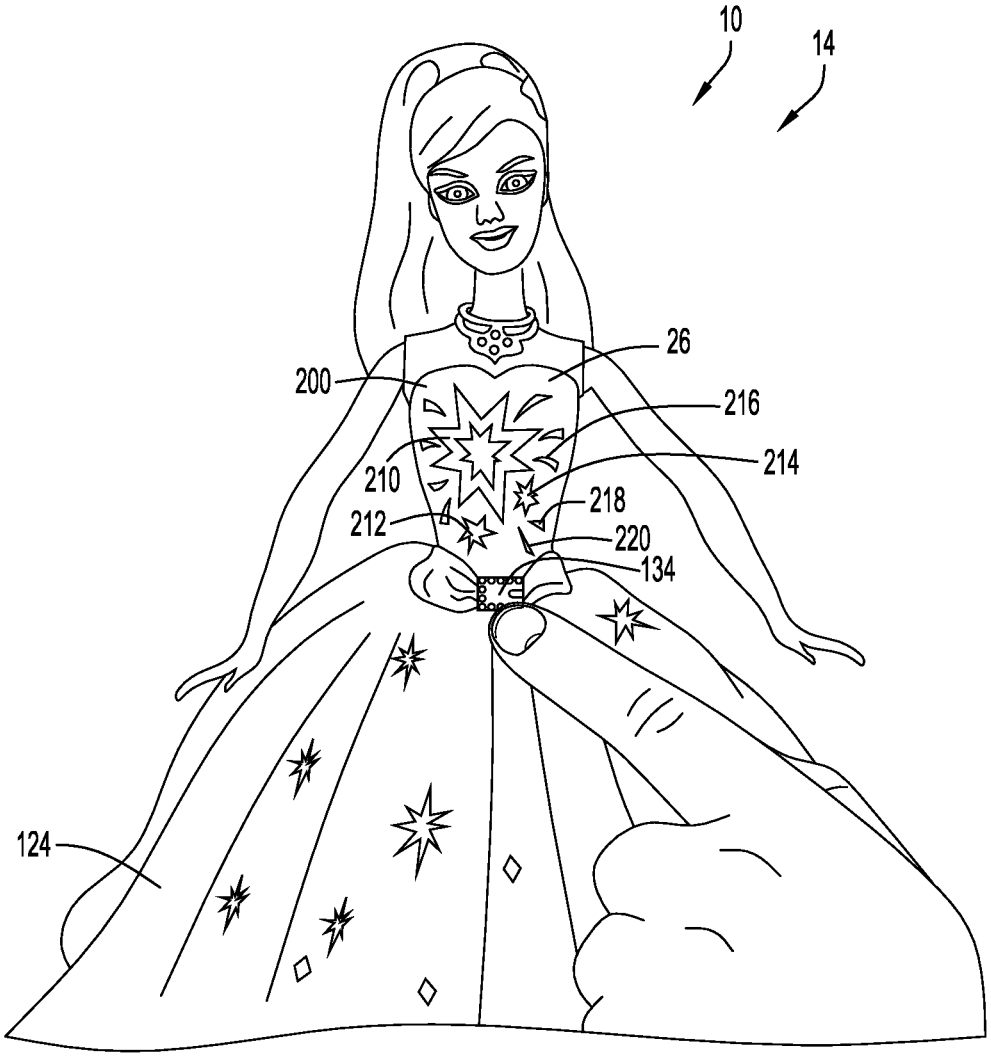
FIG. 10 illustrates a front view of the doll illustrated in FIG. 1 with the engagement member being engaged by a user.

Referring to FIG. 10, the doll 10 is illustrated in configuration 14. As shown, the engagement member 134 is exposed and can be engaged by a user. The engagement member 134 can be used to actuate an actuator (not shown in FIG. 10) to activate the electronic system of the doll 10. In this configuration 14, the bodice 26 is not covered, thereby revealing an ornamental pattern 200 and areas 210, 212, 214, 216, 218, and 220 that are transparent or translucent so that light generated inside the torso can pass therethrough. In an alternative embodiment, the portion or portions of the bodice 26 through which light shines through can be frosted to create a desired appearance when the bodice 26 is illuminated by light. The material of the bodice can be a frosted material or a translucent material with a frosted surface, such as a surface formed by sand blasting. The frosting diffuses light for better luminosity as well as distribution of even lighting and the prevention of hot spots.

In some embodiments, the clothing article 100 is coupled to a belt about the doll body 22. The clothing article 100 may be coupled to the belt by one or more fabric loops coupled to one or more notches in the belt or, additionally or alternatively, looped through perforations the belt. The belt may aid in rotating the clothing article 100 about the doll body 22.

Figure 11:
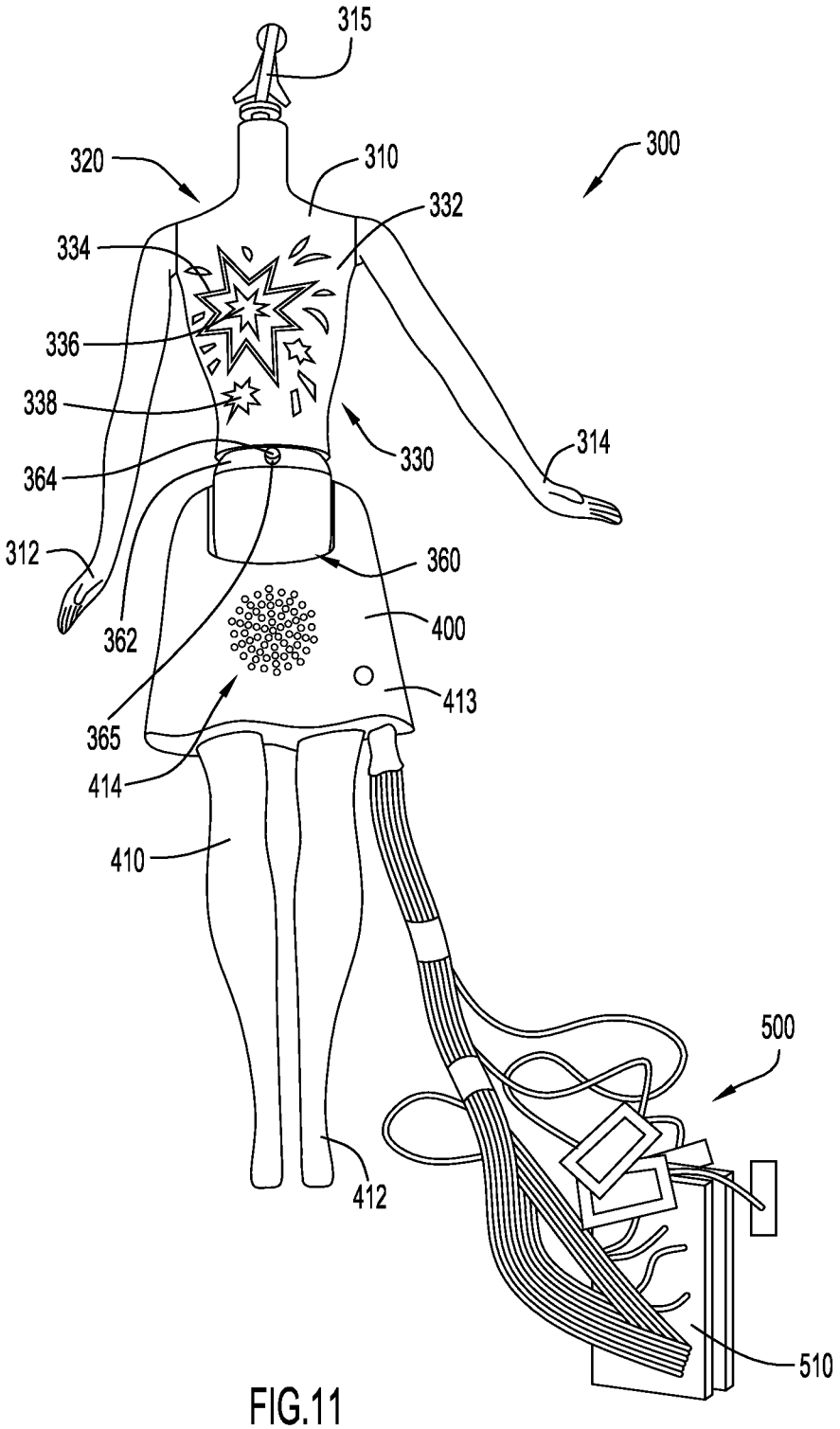
FIG. 11 illustrates a front view of another embodiment of a doll in accordance with the present invention.

Referring to FIG. 11, another embodiment of some components of a doll according to the present invention is illustrated. It is to be understood that the doll 10 described above may have many of the same components and features described with respect to the doll 300 illustrated in FIGS. 11-17. For ease of description, the clothing article, which can be the same as clothing article 100, is removed from the doll 300. Also, components of an electronic system 500, such as a PCB 510, are illustrated as being external to the doll 300. However, the system 500 is exemplary and for doll 10 and other embodiments of dolls, the various components can be located within the body of the doll 300. In an alternative embodiment, the components can be located beneath the clothing article coupled to the doll.

Referring to FIG. 11, in this embodiment, the doll 300 includes a body 310 with an upper portion 320 with a torso or torso portion 330 having a front surface 332. The torso portion 330 includes several translucent or transparent portions or areas spaced apart on the front surface 332 (only areas 334, 336, and 338 being labeled for ease of reference). The doll 300 includes a pair of arms 312 and 314 movably coupled to the body 310 as well. In addition, a head mounting structure 315 can be used to mount a head (not shown) of the doll 300 to the body 310.

The upper portion 320 includes a lower end 360 that is pivotally mounted to a lower portion or housing 400 of the doll 300. The lower end 360 includes a groove 362 formed therein and an opening 364 in which an actuator 366 is movably mounted. The actuator 366 is biased outwardly to extend outward from the groove 362 so that the actuator 366 can be engaged by an engagement member on a clothing article on doll 300, such as engagement member 134. When the actuator 366 is pressed inwardly, the electronic system of the doll 300 is activated.

Referring to FIG. 11, the doll 300 includes legs or leg portion 410 and 412 that are coupled to the lower portion 400. The lower portion 400 is a housing that has an outer surface 413 with several speaker holes or openings 414 formed therein. In addition, the housing 400 includes a compartment in which batteries, such as a button cell batteries, can be placed to provide power to the electronic system of the doll 300.

Figure 12:
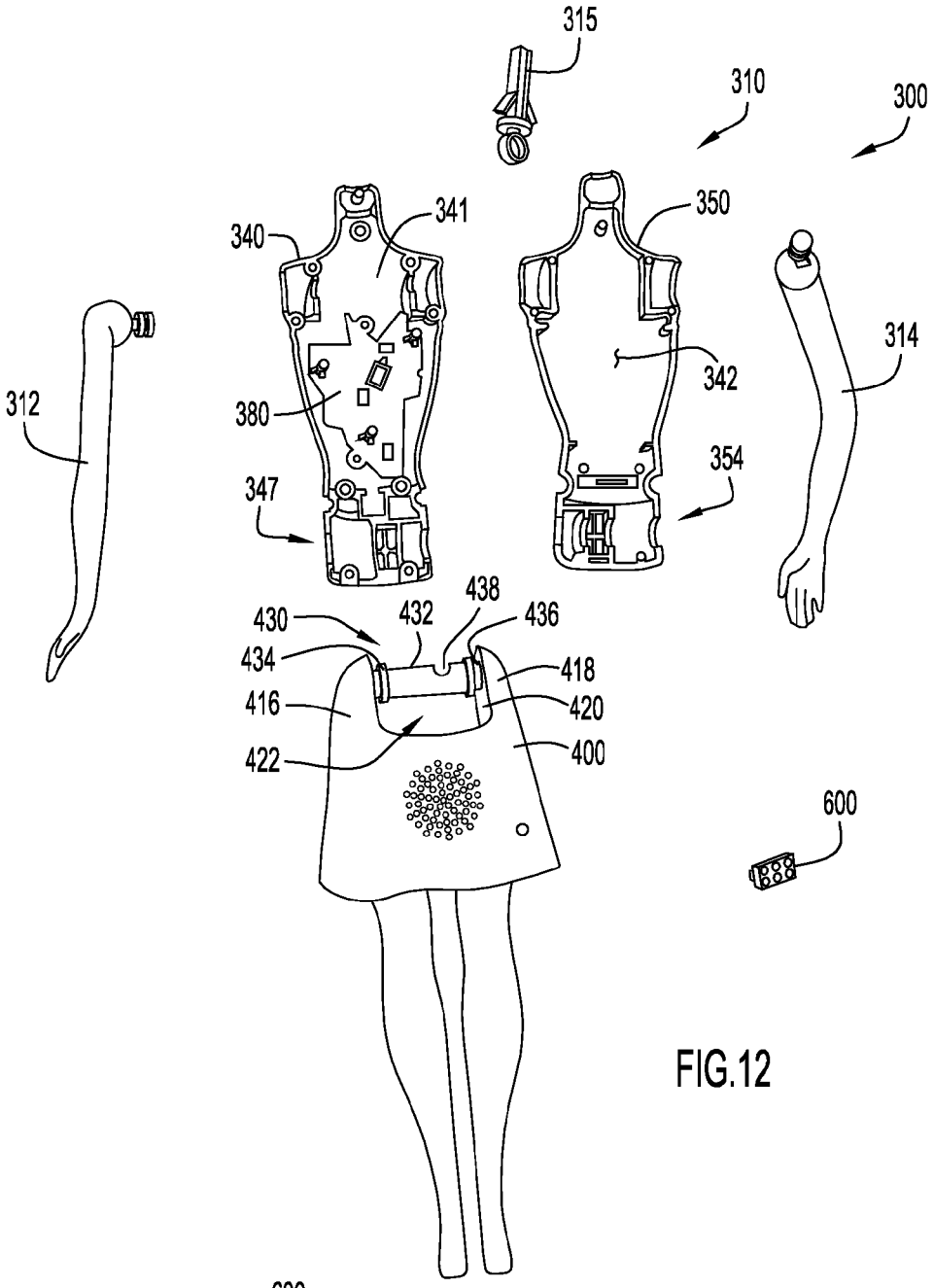
FIG. 12 illustrates an exploded front view of the doll illustrated in FIG. 11.

Referring to FIG. 12, an exploded perspective view of the components of the doll 300 are illustrated. In this embodiment, the torso portion 300 of the doll 300 includes a front housing portion 340 and a rear housing portion 350 that are coupleable together via a snap fit arrangement. Alternatively, the housing portions 340 and 350 can be coupled together using fasteners and/or an adhesive or other coupling technique or mechanism. Collectively, the housing portions 340 and 350 form an interior region 342 when the housing portions 340 and 350 are coupled together.

The lower portion 400 includes a mounting component 430 that extends between sides or side portions 416 and 418 with an edge 420 that defines a receptacle 422. In this embodiment, the front housing portion 340 includes a mounting region 347 and the rear housing portion 350 includes a mounting region 354. The mounting regions 347 and 354 can be positioned proximate to each other on opposite sides of the mounting component 430 to capture the mounting component 430 therebetween. The mounting component 430 is an elongate member or bar 432 that includes shoulders 434 and 436 formed thereon and a notch or opening 438 formed therein. The wiring of the electronic system is connected to the components in the torso portion of the doll. The wiring passes from the lower housing 400 to the interior region of the torso portion through the elongate member 432 and the opening 438 formed therein.

In addition, the doll 300 includes a guide structure or element 380 that is removably mounted to the torso portion of the doll 300. The guide structure 380 is located proximate to the inner surface 341 of the front portion 340 as shown in FIG. 12. The guide structure 380 is formed of a material that is opaque so that light in one section or external of the guide structure 380 does not blend or mix with light in a different section or external of the guide structure 380, as described below.

Figure 12A:
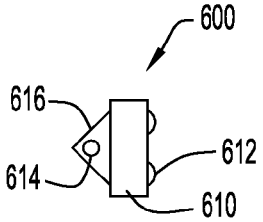
FIG. 12A illustrates a side view of the engagement member illustrated in FIG. 12.

As shown in FIG. 12, the doll 300 includes an engagement member 600 which can be coupled to a clothing article mounted to the doll 300. Referring to FIG. 12A, a side view of engagement member 600 is illustrated. In this embodiment, engagement member 600 includes a body portion 610 with several projections 612 formed on one side. On the opposite side of the body portion 610 is a mounting component 614 which includes an opening 616 that is configured to receive a string or elongate member to couple the engagement member 600 to the clothing article.

Figure 13:
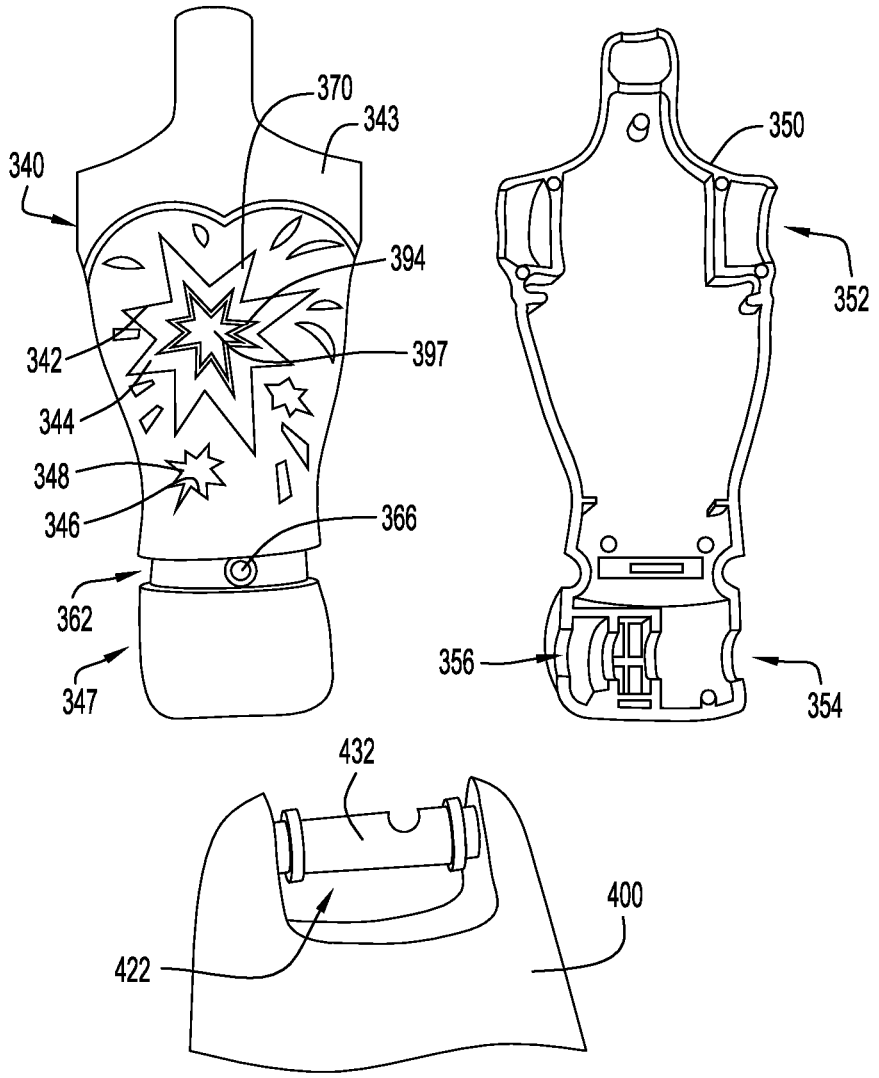
FIG. 13 illustrates a front view of some of the components of the doll illustrated in FIG. 11.

Referring to FIG. 13, the front housing portion 340 and the rear housing portion 350 are illustrated in greater detail. Front housing portion 340 has an outer surface 343 with several edges, such as edges 342 and 346, that define areas, such as areas 344 and 348. Each of the areas 344 and 348 is a translucent or transparent portion through which light can be emitted. Within the large area 344, an interior wall 394 defining an interior receptacle 397 is visible through a translucent or transparent piece of material 370, which can be referred to as a torso member or a shield member. The rear housing portion 350 includes arm mounts 351 and 352 and a lower portion mount 354 with curved ribs 356 that receive a portion of elongate member 432.

Figure 14:
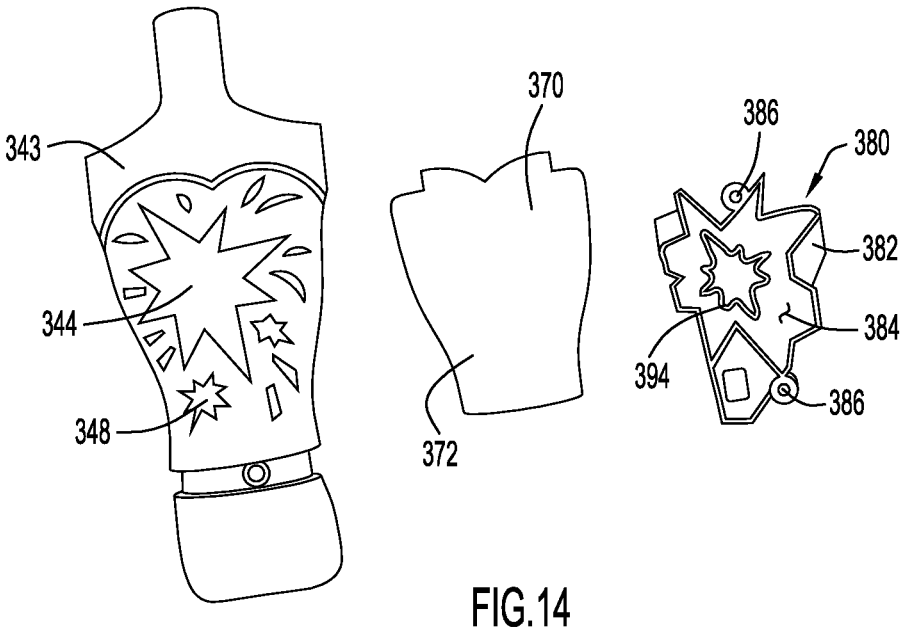
FIG. 14 illustrates a view of some of the components of the torso portion of the doll illustrated in FIG. 11.

Referring to FIG. 14, the guide structure 380 and the translucent member 370 have been removed from the front housing portion 340. The translucent member 370 is a molded plastic article that is configured so that its outer surface 372 is placed in contact with the inner surface 341 (see FIG. 12) of the front housing portion 340. The translucent member 370 is sized so that each of the openings formed in the outer surface 343 of the front housing portion 340 is aligned with a portion of the translucent member 370, thereby forming different translucent portions that are visible.

Figure 15:
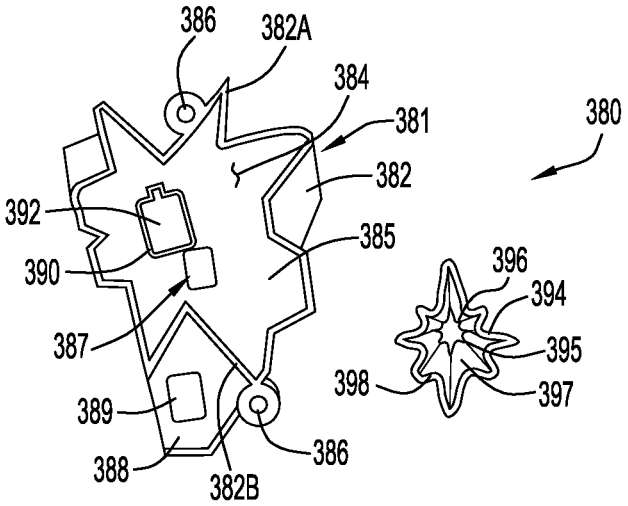
FIG. 15 illustrates a view of some of the components illustrated in FIG. 14 separated from each other.

The guide structure 380 includes multiple components, as shown in FIGS. 14 and 15. Referring to FIG. 15, the guide structure 380 includes a main body portion 381 with a wall 382 and a lower, inner surface 385. The wall 382 has an outer surface or end 382A that is placed proximate to and in contact with the inner surface of the shield member 370. In one embodiment, the thicknesses of the walls of the guide structure 380 are approximately 0.060 inches.

Figure 16:
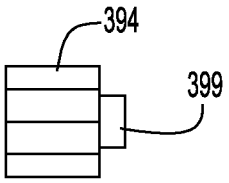
FIG. 16 illustrates a side view of a component illustrated in FIG. 15.

The wall 382 and the lower surface 385 collectively define an interior region or chamber 384. The lower surface 385 includes an opening 387 formed therein through which one or more LEDs can be inserted so that the LEDs are located within the chamber 384. When an LED in chamber 384 is illuminated, the entire chamber 384 is illuminated. The main body portion 381 also includes an inner wall 390 that defines a receptacle 392. The wall 390 prevents light in chamber 384 from entering the receptacle 392. A separate body or structure 394 can be placed so that a portion of the structure 394 is inserted into the receptacle 392 as shown in FIG. 14. In FIG. 15, structure 394 is illustrated as being removed from the main body portion 381. Referring to FIG. 16, a side view of the structure 394 is illustrated. The structure 394 includes a mounting portion 399 that is engageable with the receptacle 392.

Referring back to FIG. 15, the structure 394 includes edge 395 that defines an opening 396 in the lower surface 397 of the structure 394. The opening 396 is configured so that one or more LEDs can be inserted therethrough and into the chamber 398 defined by the wall of the structure 394. An LED inserted into chamber 398 can be illuminated at either the same and/or different times as compared to the LED inserted into chamber 384. In addition, the LEDs can be different colors. The different illumination timings and/or colors of the LEDs can create different visual appearances of the doll 300 because the openings in the front housing portion 340 through which the light from the LEDs is visible is determined by the particular chamber with which the openings are aligned.

The wall 382 also includes a portion 382B (see FIG. 15) that defines a smaller receptacle or chamber 388 that is aligned with different openings in the front housing portion 340 than chamber 384 and chamber 398. An opening 389 is formed in the lower surface defining the chamber 388. An LED can be inserted into the opening 389 and illuminated to provide light to the chamber 388 and the particular opening or openings in the front housing portion 340 that are aligned with the chamber 388.

The body 381 includes several mounting openings 386 that can be used to secure the guide structure body 381 to another component of the doll 300, such as the shield member 370. For example, the shield member 370 may include posts that can be inserted into the openings 386 and retaining therein via friction.

Figure 17:
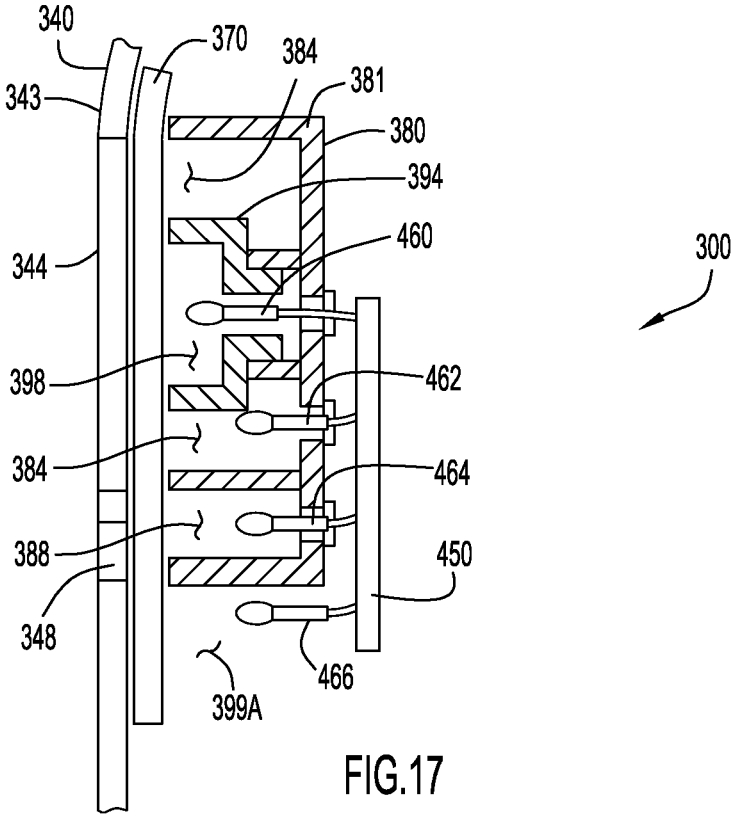
FIG. 17 illustrates a cross-sectional side view of some components of the doll illustrated in FIG. 11.

Referring to FIG. 17, a cross-sectional view of some of the components of the doll 300 is illustrated. As shown, the guide structure 380 and the inner structure 394 collectively form different chambers 384, 398, and 388 as described above. The outer surface of the main body 381 also defines another area 399A outside of the guide structure 380. Several LEDs are inserted into the different chambers or areas. The LEDs can be mounted to a PCB 450 as illustrated. In this embodiment, LED 460 is located within chamber 398, LED 462 is located within chamber 384, LED 464 is located within 388, and LED 466 is located in the outer area 399A in the interior of the doll body 310.

Depending on which of the LEDs 460, 462, 464, and 468 are illuminated, different parts of the torso of the doll 300 will be illuminated. For example, the illumination of LED 460 will result in only a portion of opening 344 that is aligned with chamber 398 being illuminated. The illumination of LED 462 will result in a larger portion of opening 344 aligned with chamber 384 being illuminated. The illumination of LED 464 will result in opening 348, which is aligned with chamber 388, being illuminated. The illumination of LED 466 will result in any openings in the front housing portion 340 that are aligned with area 399A being illuminated.

In one embodiment, each chamber or wall section includes its own LED, which can be mounted to the back of the plastic guide structure 380. When the LEDs are illuminated, each separate section independently projects light through its solid wall, thereby creating an optical illusion of movement as the light appears to be moving through a series of animated steps, such as creating the illusion of a star bursting in air to the sound and music.

While FIG. 17 illustrates single LEDs 460, 462, 464, and 466 in the different chambers, in alternative implementations, a single LED can be replaced with multiple LEDs for a particular chamber, as described below.

Figure 18:
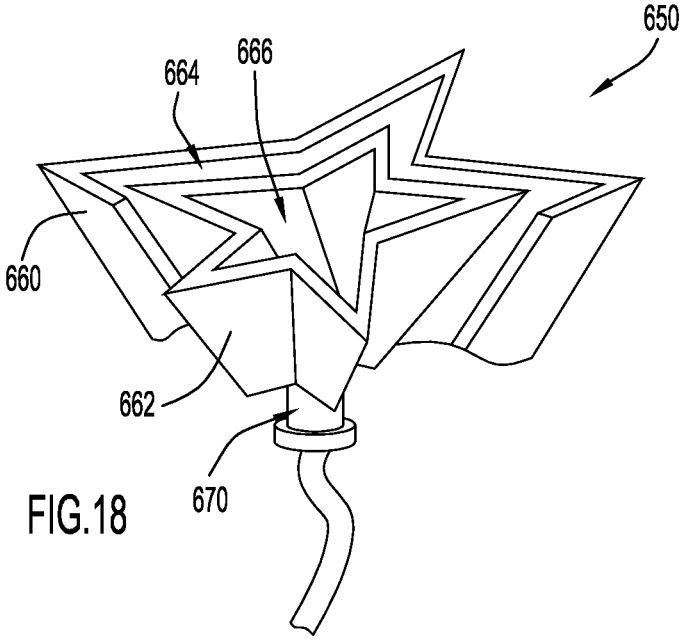
FIG. 18 illustrates an alternative embodiment of a guide structure according to the present invention.

In an alternative embodiment, the configuration of the guide structure 380 can vary. For example, as illustrated in FIG. 18, a guide structure 650 according to the invention may include multiple plastic walls 660, 662 that are placed in a concentric configuration shaped like a starburst. Each nested shape or wall can be lit by a different LED that is illuminated in sequence, thereby creating an animated starburst effect. In FIG. 18, wall 660 defines an interior region 664 and wall 662 defines an interior region 666, with wall 662 being located within wall 660. An LED 670 is located so that it illuminates the interior region 666.

Figure 18A:
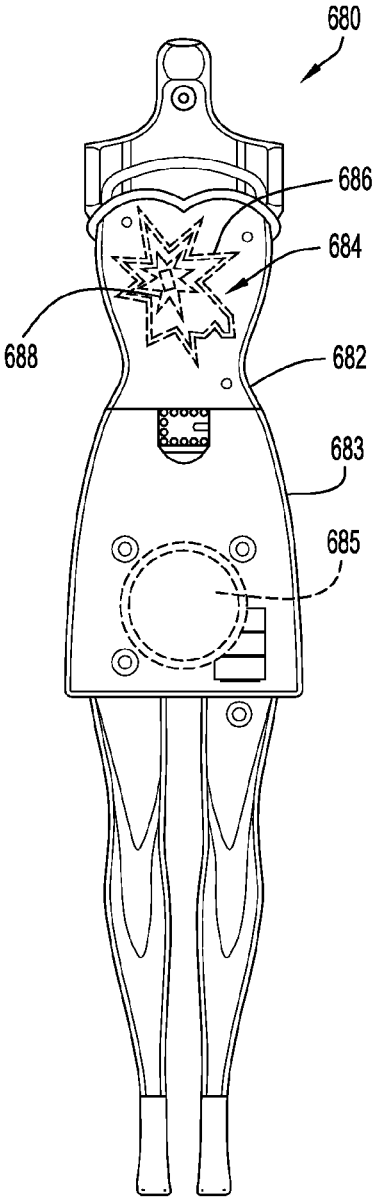
FIG. 18A illustrates an alternative embodiment of a doll according to the present invention.
Figure 18B:
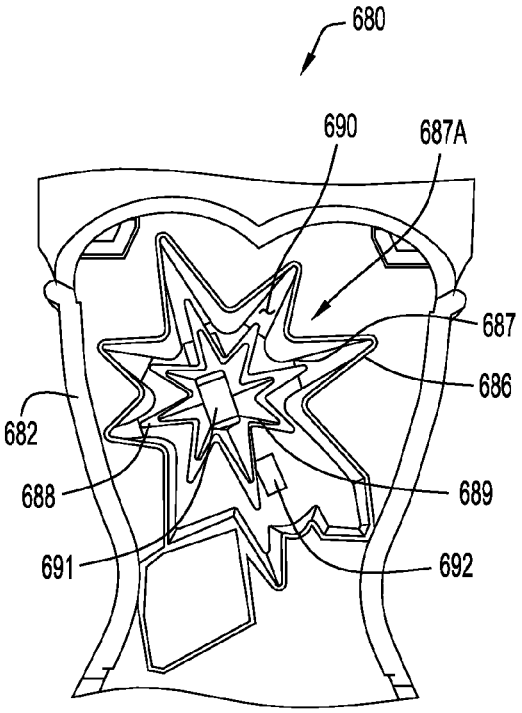
FIG. 18B illustrates a close-up view of the light component of the doll illustrated in FIG. 18A.

Referring to FIGS. 18A and 18B, an alternative embodiment of a doll according to the present invention is illustrated. In this embodiment, the doll 680 includes a body 682 and a skirt portion 683. The light structure 684 located in the torso of the doll body 682 is illustrated in phantom in FIG. 18A and drawn in solid lines in FIG. 18B. The doll 680 includes a speaker 685 located in the skirt portion 683. As shown, the light structure 684 includes an outer housing 686 that has an inner wall surface 687 and an inner housing 688 nested within the outer housing 686. The outer housing 686 includes several openings through which light can pass from light sources (only opening 692 is illustrated in FIG. 18B). The inner housing 688 includes an inner wall surface 689 and an opening 691 through which light can pass from one or more light sources. The outer housing 686 and the inner housing 688 are spaced apart from each other by a gap 690.

In one embodiment, the walls of the outer housing 686 and the inner housing 688 are tapered to enhance the distribution of light from the light sources. The wall, including the inner wall surface 687, of the outer housing 686 is tapered from its inner end to its outer end proximate to the front of the doll at an angle of approximately 10°. In addition, portions of the inner wall surface 687, such as portion 687A, are slightly rounded to enhance the light diffusion and distribution in the receptacle or chamber. Also, the wall, including the inner wall surface 689, of the inner housing 688 is tapered from its inner end to its outer end proximate to the front of the doll at an angle of approximately 20°.

Figure 19:
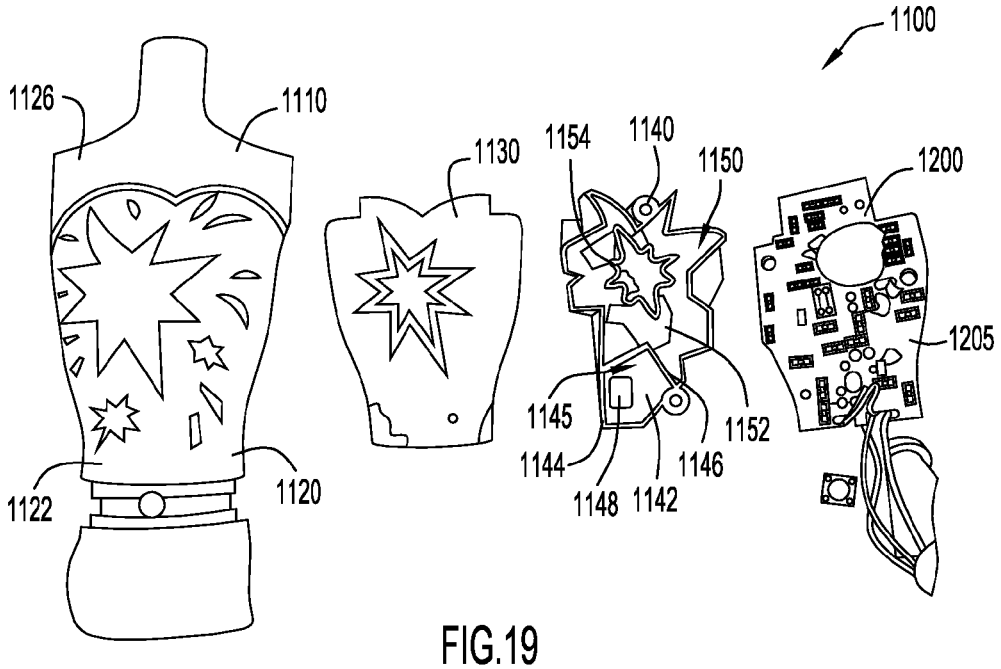
FIG. 19 illustrates an exploded view of some components of another embodiment of a doll according to the present invention.
Figure 20:
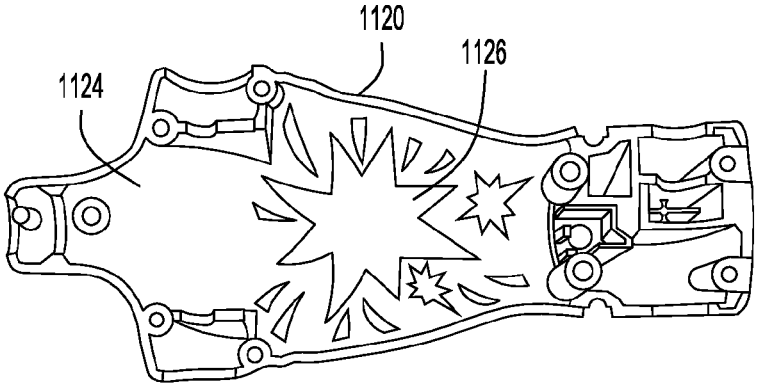
FIG. 20 illustrates a view of the inner surface of a torso portion of the doll illustrated in FIG. 19.

Referring to FIG. 19, an exploded view of some of the components of another embodiment of a doll according to the present invention is illustrated. Only a portion of the doll 1100 is shown for ease of reference. In this embodiment, the doll 1100 includes a torso portion 1110 that has a front housing portion 1120. The front housing portion 1120 includes an outer surface 1122 with a textured material, such as glitter, disposed thereon. The housing portion 1120 includes several openings 1126 that extend between the outer surface of the portion 1120 and the inner surface 1124 of the portion 1120, which is illustrated in FIG. 20. The openings 1126 may resemble a starburst.

Referring back to FIG. 19, the doll 1100 includes an insert member 1130, which may be translucent or transparent, that is placed proximate to the inner surface 1124 of portion 1120. A guide structure 1140 is placeable in contact with the inner surface of the insert member 1130. The guide structure 1140 has several different cavities or receptacles into which light can enter. The different cavities facilitate the illumination of different portions of the insert member 1130 and thus, the torso portion 1110.

As illustrated, the guide structure 1140 includes a main body portion or plate 1142 with an outer wall 1144 and an inner wall 1146. The walls 1144 and 1146 define receptacles 1145 and 1150 that can be used to separate light from different light emitting sources. The plate 1142 includes several openings 1148, 1152, and 1154 that extend therethrough. Opening 1148 is in communication with receptacle 1145, and openings 1152 and 1154 are in communication with receptacle 1150.

In this embodiment, the guide structure 1140 is mounted onto a printed circuit board 1200. The printed circuit board 1200 has an upper or outer surface 1205 that is located proximate to the guide structure 1140. In one embodiment, surface 1205 is painted white to enhance the reflection of light from light emitting devices on the circuit board 1200 out of the torso portion 1110 of the doll. In addition, the guide structure 1140 and the insert 1170 are molded of a white plastic material, which enhances the brightness of the light from inside the torso of the doll when the light is illuminated. In an alternative embodiment, the guide structure 1140 and 1170 may be molded a different color and may be painted or coated white. The circuit board 1200 includes several light emitting devices, such as LEDs, that are proximate to the openings formed in the plate 1142 so that light from the LEDs is transmitted through the guide structure 1140.

Referring to FIG. 20, in this embodiment, the inner surface 1124 of the front housing portion 1120 is coated with a reflective layer of material, such as paint. The reflective material isolates or seals the interior of the doll body and prevents light in the interior of the body from passing through the front housing portion 1120, including the neck area and the sides of the torso, other than through the openings 1126. In one embodiment, the reflective material is silver.

Figure 21:
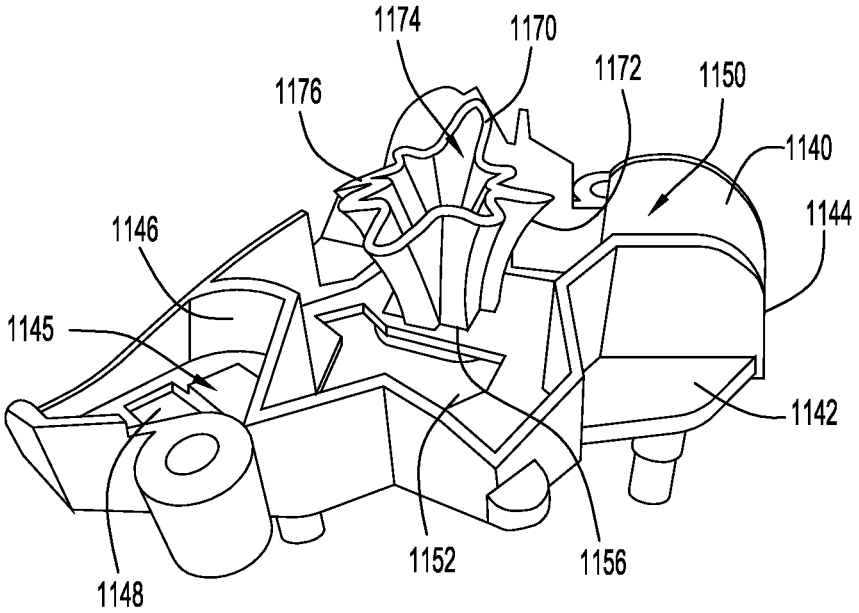
FIG. 21 illustrates a perspective view of an alternative embodiment of guide structure according to the present invention.
Figure 22:
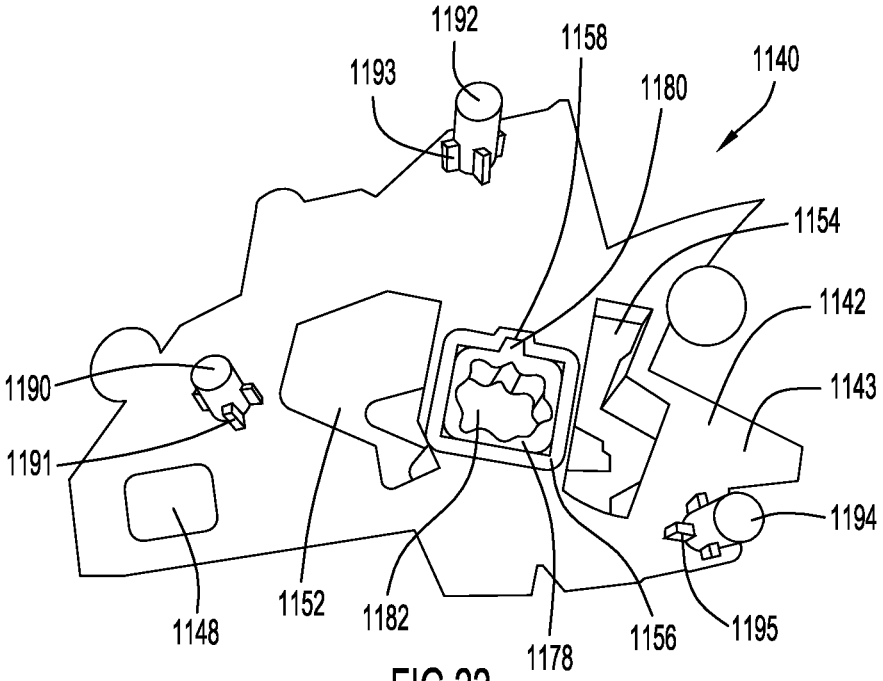
FIG. 22 illustrates a bottom view of the guide structure illustrated in FIG. 21.

Referring to FIGS. 21 and 22, a perspective view and a bottom view of the guide structure 1140 are illustrated, respectively. The walls 1144 and 1146 of the guide structure 1140 are illustrated in FIG. 21 with the receptacles 1145 and 1150 shown as well as openings 1148, 1152, and 1156. The walls 1144 and 1146 are coupled to the base plate 1142.

In this embodiment, the guide structure 1140 includes an insert 1170 that is removably coupleable to the plate 1142. The insert 1170 includes a wall 1172 that defines a passageway or receptacle 1174 through the insert 1170. The wall 1172 has an upper end 1176 and a lower end 1178, which is illustrated in FIG. 22. In addition, the lower end 1178 of the wall 1172 includes a projection 1180 on one side and an opening 1182 in communication with receptacle 1174. The nesting of the insert 1170 with the guide structure 1140 isolates light from an LED illuminating the receptacle 1174 from light from another LED that is illuminating a different receptacle of the guide structure 1140. The wall 1172 of the insert 1170 is flared at an angle to match the LED beam dispersion or the beam angle of an LED. The flaring of the wall 1172 facilitates the dispersion of light from the LED and provides optimum light visibility from the doll to a user.

Referring to FIG. 22, the openings 1148, 1152, 1154, and 1156 in the lower surface 1143 of the plate 1142 are illustrated. One of the walls that defines the opening 1156 includes a recess or groove 1158 formed therein that is sized to receive the projection 1180. The engagement of the projection 1180 with the recess 1158 ensures that the insert 1170 is engaged with the opening 1156 in the plate 1142 in the proper orientation.

The guide structure 1140 includes several mounting elements which are used in the coupling of the guide structure 1140 with the circuit board 1200. Extending from the lower surface 1143 of the plate 1142 are posts 1190, 1192, and 1194 which are insertable into openings formed in the circuit board 1200, as described below. Post 1190 includes one or more teeth or ridges 1191 that extend laterally from the post 1190 and that engage the upper surface 1205 of the circuit board 1200. Similarly, post 1192 includes teeth or ridges 1193 and post 1194 includes teeth or ridges 1195. As described below with reference to FIG. 24, the teeth on the posts 1190, 1192, and 1194 prevent the surface 1143 from contacting the upper surface 1205 of the circuit board 1200 and maintains the guide structure 1140 at a relative spacing from the LEDs on circuit board 1200.

Figure 23:
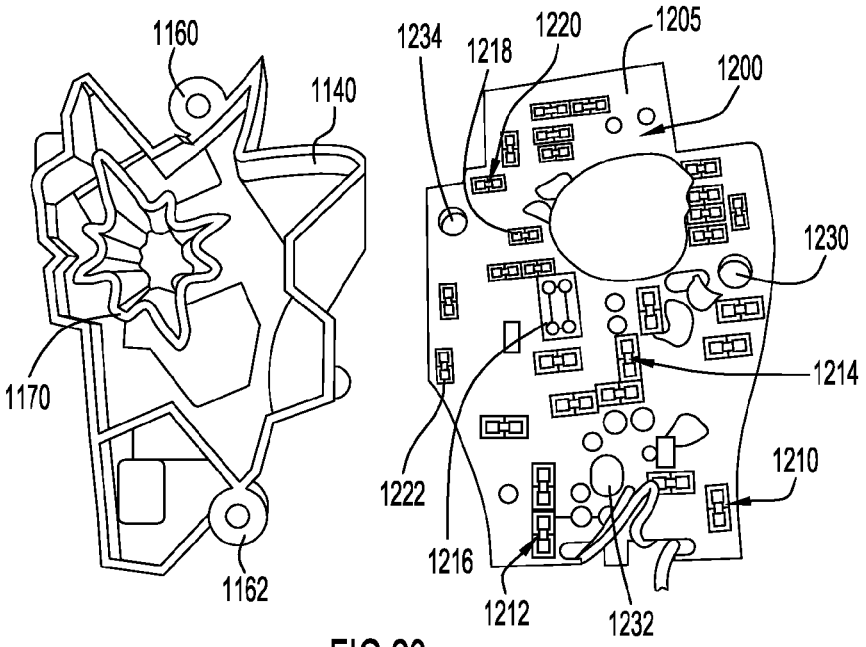
FIG. 23 illustrates an exploded top view of the guide structure illustrated in FIG. 21 and a printed circuit board according to the present invention.
Figure 24:
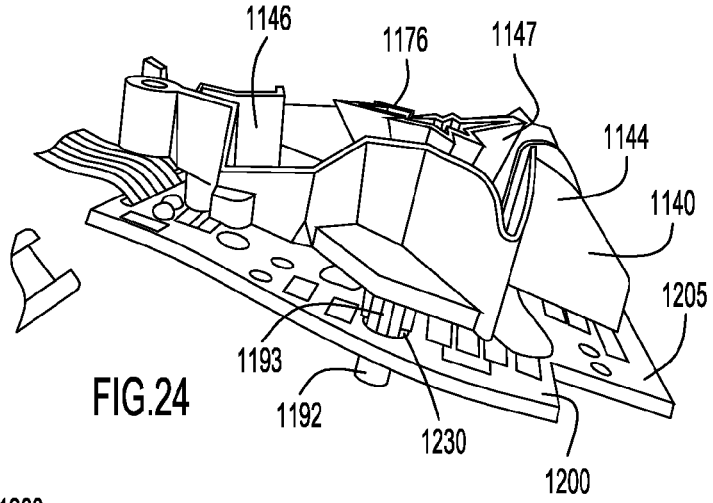
FIG. 24 illustrates a side perspective view of the guide structure and the circuit board illustrated in FIG. 23 in an assembled configuration.
Figure 25:
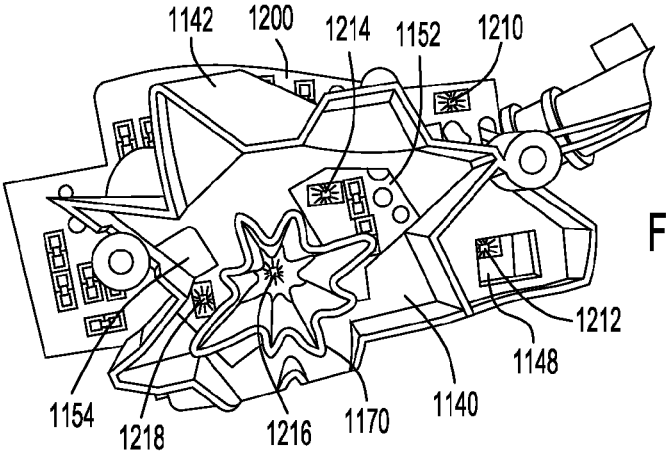
FIG. 25 illustrates a top view of the guide structure and the circuit board illustrated in FIG. 24.

Referring to FIGS. 23-25, the interaction of the guide structure 1140 with insert 1170 and the circuit board 1200 are described. As shown in FIG. 23, the guide structure 1140 includes mounting portions 1160 and 1162 that have openings into which connectors, such as posts on a rear surface of the insert member 1130, may be inserted to couple the guide structure 1140 inside the doll body.

As illustrated in FIG. 23, the circuit board 1200 includes several LEDs 1210, 1212, 1214, 1216, 1218, and 1220 mounted thereto. The LEDs 1210, 1212, 1214, 1216, 1218, 1220, and 1222 are located so as to align with corresponding openings 1148, 1152, 1154, and 1156 in the guide structure 1140 and opening 1182 in insert 1170.

In this embodiment, the circuit board 1200 includes openings 1230, 1232, and 1234 that extend through the board 1200. The openings 1230, 1232, and 1234 are configured or sized to receive one of the posts 1190, 1192, and 1194 of the guide structure 1140. As shown in FIG. 24, post 1192 is inserted into opening 1230 of the circuit board 1200 and the teeth 1193 contact the upper surface 1205 of the board 1200 to maintain the lower surface 1143 at an offset from the upper surface 1205. This distance between the upper surface 1205 and the lower surface 1143 ensures that the LEDs are at the proper location and at the right focal point relative to the corresponding opening 1148, 1152, 1154, or 1156 in the plate 1142 so that the desired amount of illumination from the LEDs enters the corresponding receptacle of the guide structure 1140. This spacing enhances the uniform lighting effect of a receptacle and thus, the light output therefrom. In addition, the spacing of the LEDs from the guide structure 1140 reduces the formation of any "hot spots" or "shadows", or locations that are too bright or too dim, on the guide structure 1140.

As illustrated in FIG. 24, the upper surfaces 1147 of the walls 1144 and 1146 and upper surface 1176 of insert 1170 are curved or tapered so as to match the contour of the inner surface of the insert member 1130. When the upper surfaces 1147 engage or contact the inner surface of the insert member 1130, any light in a receptacle of the guide structure 1140 is directed to exit through the insert member 1130 and the torso portion 1110 of the doll body.

Referring to FIG. 25, a top view of the guide structure 1140 mounted on the circuit board 1200 is illustrated. As shown, LED 1210 is located outside of the guide structure 1140 and may be aligned with one or more of the smaller openings in the torso portion 1110. LED 1214 is aligned with opening 1152 in the plate 1142, LED 1212 is aligned with opening 1148 in the plate 1142, LED 1216 is aligned with the opening 1182 in the insert 1170, and LED 1218 is aligned with opening 1154 in the plate 1142. As a result, the receptacle 1174 of the insert 1170 is illuminated by LED 1216. In addition, receptacle 1150 is illuminated by LEDs 1214 and 1218, and receptacle 1145 is illuminated by LED 1212.

The separation and isolation of light in the different receptacles of the guide structure 1140 and the insert member 1170 facilitate the generation of the illusion of light moving about the doll.

Figure 26:
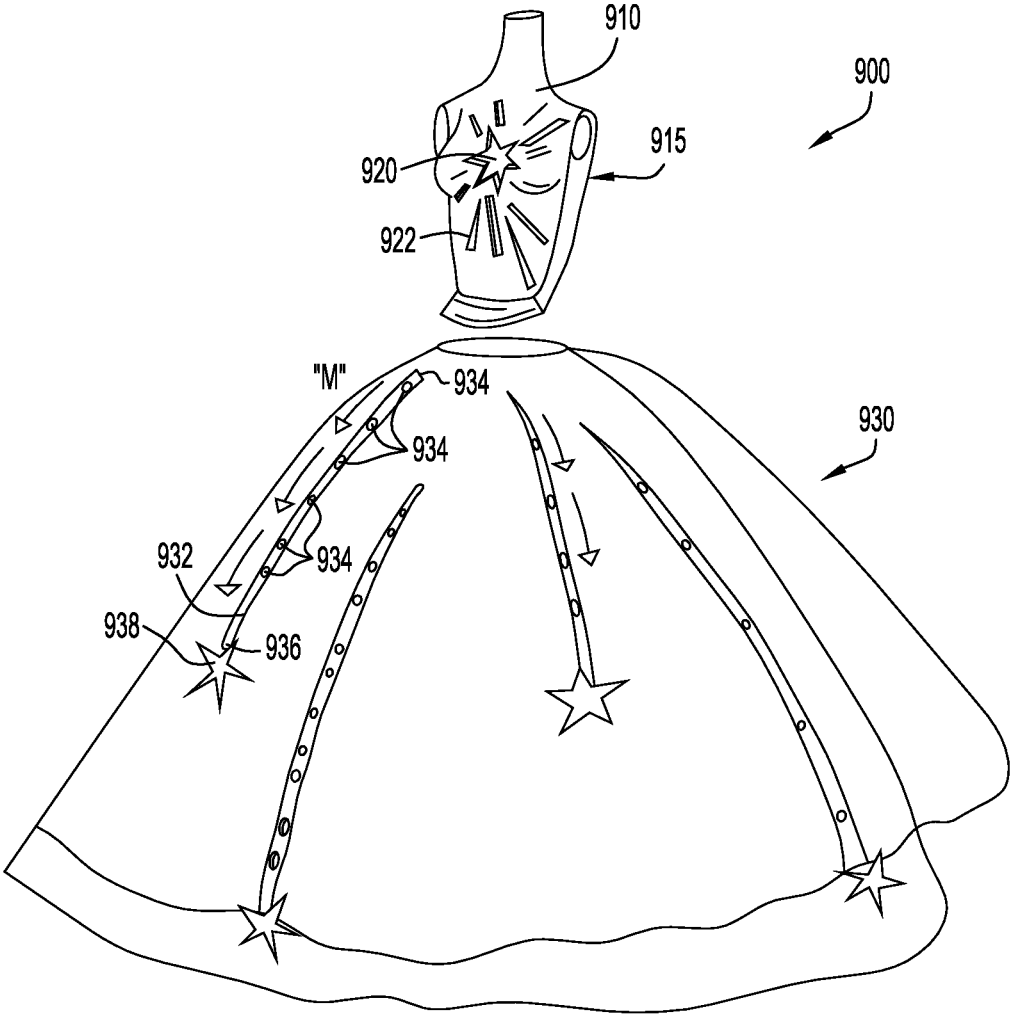
FIG. 26 illustrates an alternative embodiment of a doll and clothing article according to the present invention.

Referring to FIG. 26, an alternative embodiment of a portion of a doll and a clothing article is illustrated. The doll 900 includes a torso portion 910 with a display portion 915 with light-up areas, such as a center star portion 920 and outer portions 922, that can be illuminated by internal LEDs. The timed illumination of lights in sequence creates the illusion of an animated or moving graphic image, such as a bursting star, as star portion 920 is initially illuminated and then outer portions 922 are illuminated.

The doll 910 includes a clothing article 930 resembling a dress or gown. In this embodiment, the clothing article 930 includes light strips 932, each of which includes several light sources 934 spaced apart along the length of the light strip 932. The light sources 934 along a strip 932 are illuminated in sequence along the direction of arrows "M" from an upper end 934 of the strip 932 to the lower end 936 of the strip 932. Proximate to the lower end 936 of each strip 932 is an object 938 that can be illuminated with an LED. As the light sources 934 are illuminated along the length of the strip 932, the appearance of a shooting star is created along the length of the strip 932 with the object 938 being illuminated last.

In an alternative implementation, the objects 938 can be illuminated randomly via LEDs which creates the appearance of sparkling lights in the clothing article 930. Such illumination can occur simultaneously with the generation of firework popping sounds generated by the doll 910. For example, each popping sound generated can be accompanied by the flashing of an LED.

In another implementation, one or more objects, such as frosted fairies or charms, can be coupled to or snapped onto the strip or belt 932 on the clothing article 930 proximate to one or more of the light sources or LEDs 934 to cover the light sources. The objects may be transparent or translucent so that light from a light source may pass through the object and illuminate the same. The fairies or charms can light up synchronizing with music along with the light-up bodice.

Figure 27:
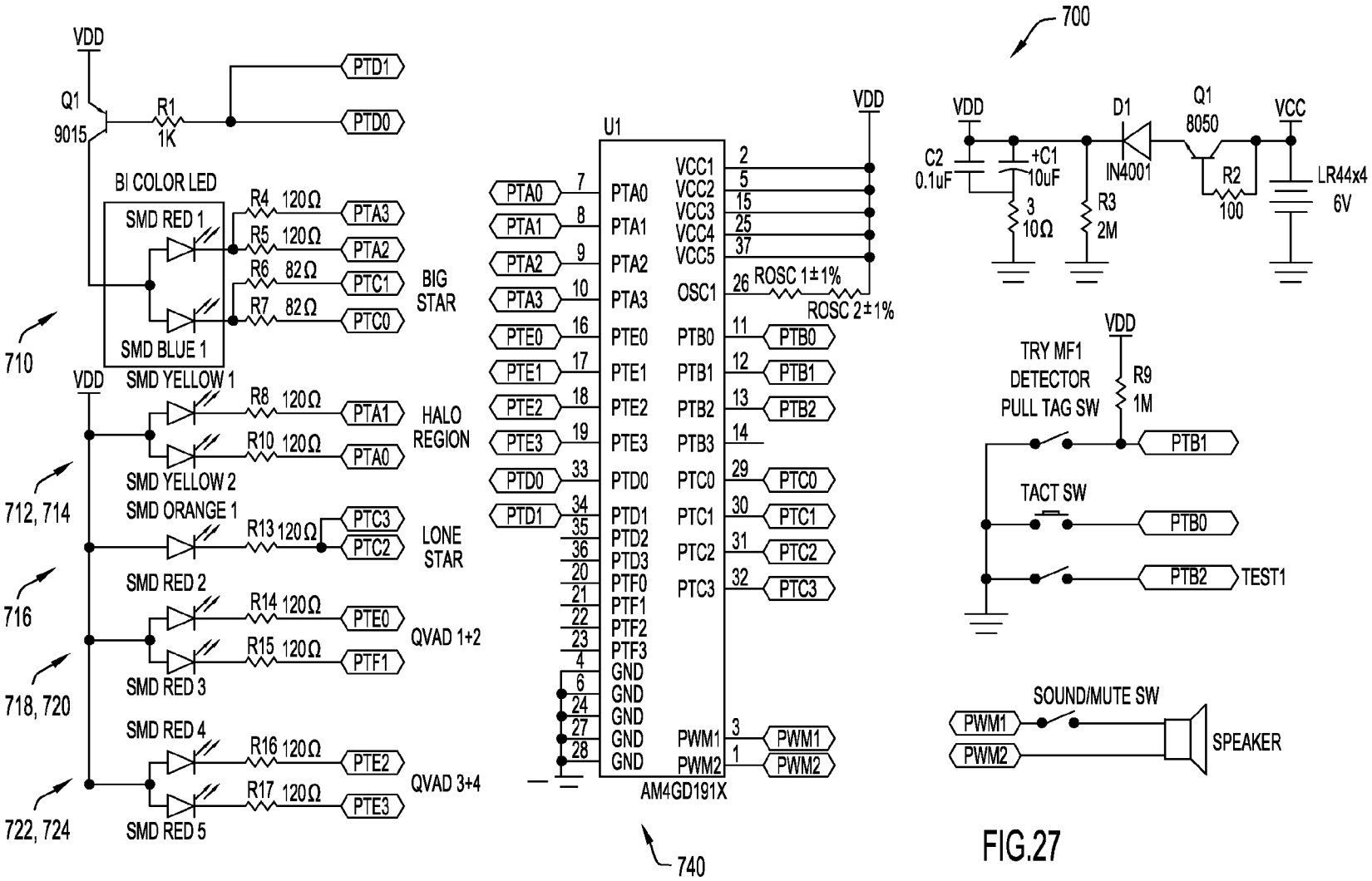
FIGS. 27-31 illustrate schematic diagrams of different embodiments of electronic systems according to the present invention.

Referring to FIG. 27, a schematic showing an embodiment of the circuit of the electronic system for the dolls 10, 300, and 910 is illustrated. In this embodiment, the circuit includes one bi-color LED 710. While two ports are feeding the PNP transistor driving the device, those processor ports are tied together at the base and the same routine is called in the program to pulse-width modulate them (D0 and D1). In addition, the collector of that same transistor is tied to the common anode of the bi-color LED package 710. In this implementation, the bi-color LED 710 has three pins—a common anode, a red cathode, and a blue cathode.

In this embodiment, there are four light clusters that are separated from each other by the guide structure 380. The different parts of the guide structure 380 can be referred to alternatively as diffuser cups.

One light cluster is formed by the single bi-color LED 710 that is aligned with the big star opening 344 formed in the front housing portion 340 of the doll 300 and in the similar location on doll 10. The bi-color LED 710 is switched between pink and purple colors and is used to illuminate chamber 398.

Another light cluster is made up of two yellow LEDs 712 and 714 whose cathodes are independently controlled by separate ports. The yellow LEDs 712 and 714 are aligned with the halo opening in the front housing portion 340 which extends around the big star opening. In one implementation, the yellow LEDs 712 and 714 are used to illuminate chamber 384. The yellow LEDs 712 and 714 can be illuminated at the same time.

Another light cluster is made up of a single orange LED 716 whose cathode is controlled by a single port. The orange LED 716 is aligned with the smaller star opening 348 in the front housing portion 340. In one implementation, the orange LED 716 is used to illuminate chamber 388.

Finally, another light cluster is made up of four red LEDs 718, 720, 722, and 724. The red LEDs are connected so that separate pulse-width modulation signals can be sent to the cathodes for the red LEDs. The four red LEDs are spaced apart in the interior region 399A (shown in FIG. 17) on the outside of the guide structure 380. Accordingly, the red LEDs are aligned with the small openings in the front housing portion 340 that resemble streamers.

The red and blue cathodes of the bi-color LED 710 are connected back to the processor 740 when the grounds will be switched in and out depending on the desired color (either pink or purple). In this embodiment, pulse-width modulation is not applied to the ports associated with those grounds and only occasional switching of the ports will occur with the audible output, such as a song, is playing.

In this embodiment, none of the individual clusters of LEDs (the bi-color LED, the yellow LEDs, the orange LED, and the red LEDs) are blended with each other. Each of the colors is kept separate from each other visually by way of the guide structure. Thus, by partitioning the LED clusters, a user viewing the doll will perceive and view motion of the lights as the different light clusters are illuminated. The LED clusters can be illuminated in a pattern in which the inner star is illuminated and then the halo and then the outer areas, thereby simulating fireworks or similar explosion of light. Music and/or sound effects can be generated at the same time and the illumination of the clusters can be coordinated with particular notes, beats or other component of the audible output that is generated.

In an alternative embodiment, the clothing article 100 may include one or more LEDs coupled thereto that are illuminated by the electronic system of the doll 10. Referring to FIG. 2, an exemplary LED 128 coupled to the clothing article 100 is illustrated as shown.

In an alternative embodiment, the visual display 115 on the doll 10 varies in intensity, color, and movement. In this embodiment, the system includes a controller with at least four output ports and at least two LEDs with separate and distinct wavelengths. One port can pulse width modulate its output and cause one or more of the LEDs to become forward biased. A second port can provide a current path that routes the current through a predetermined resistor network that is set for a particular color shade that is observed with the user views the multiple diodes.

Figure 28:
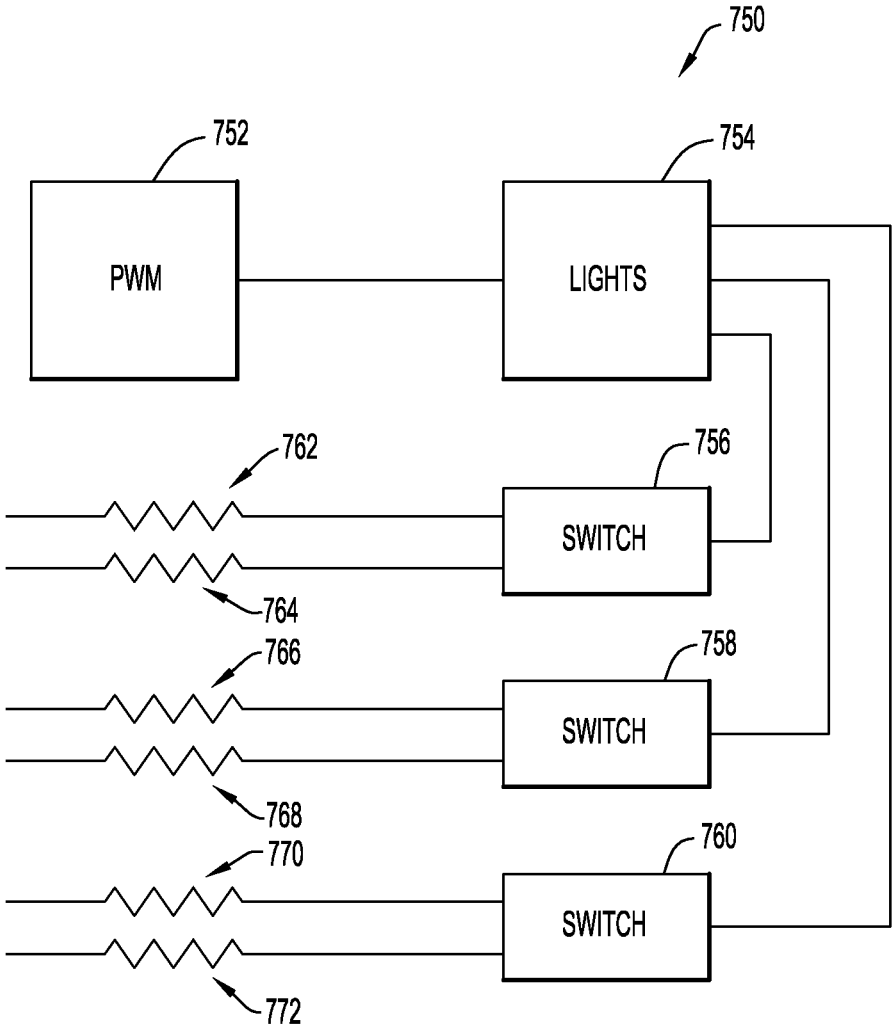

In FIG. 28, a schematic view of an alternative embodiment of some components of an electronic system that can be used with a doll according to the present invention is illustrated. In this schematic, the system 750 includes a controller 752 that utilizes pulse-width modulation to control the output of lights 754 in the system 750. The system 750 also includes several switches 756, 758, and 760 and resistors 762, 764, 766, 768, 770, and 772, respectively, that are connected to the different lights 720 and that are downstream of the lights 720.

Figure 29:
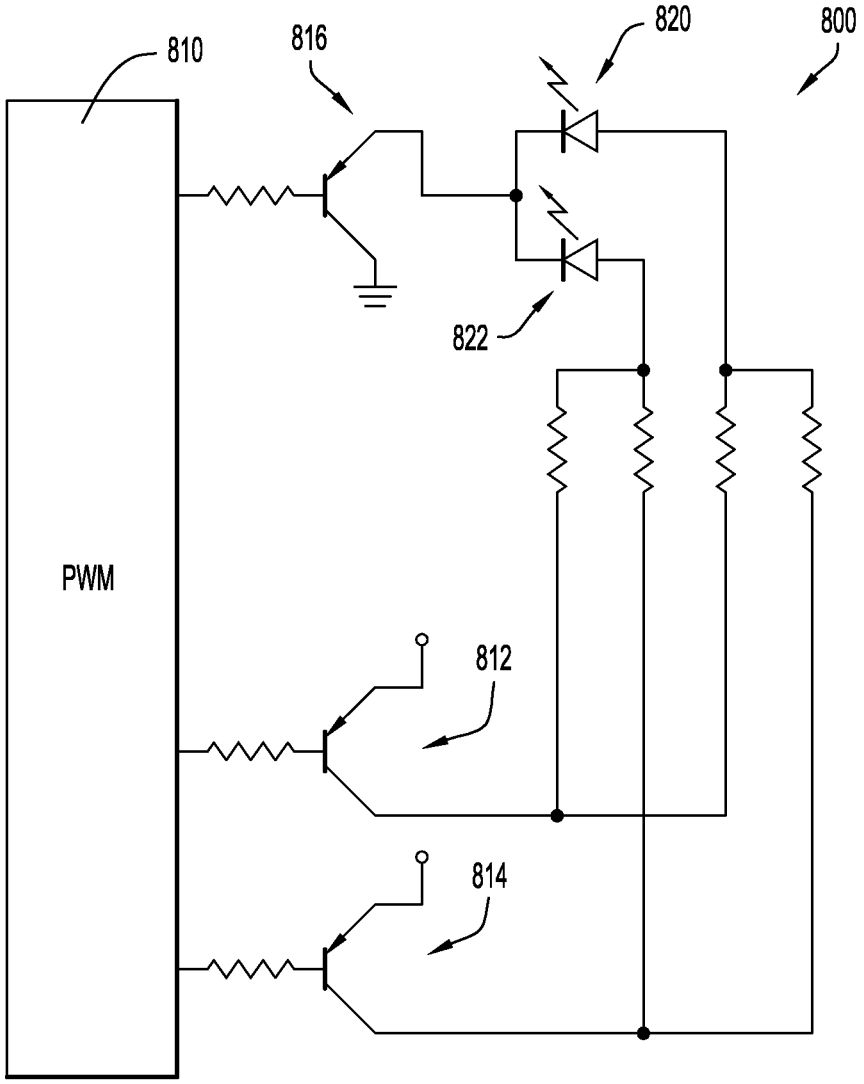

In FIG. 29, a schematic view of an alternative embodiment of some components of an electronic system that can be used with a doll according to the present invention is illustrated. In this schematic, the system 800 includes a controller 810 to which switches 812 and 814, and component 816 are connected. A pair of LEDs 820 and 822 are provided which are controlled using the switches 812 and 814 and the resistors connected thereto as shown.

Figure 30:
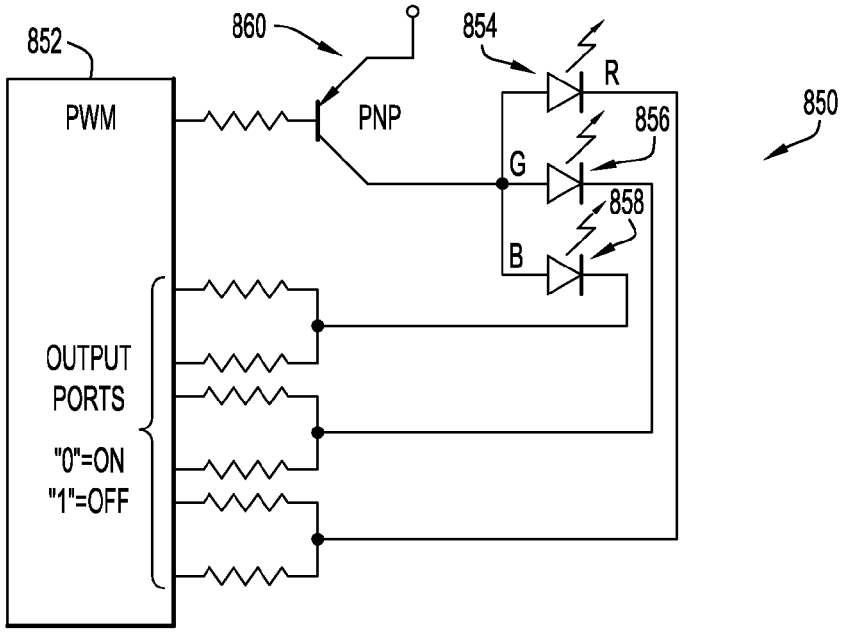
Figure 31:
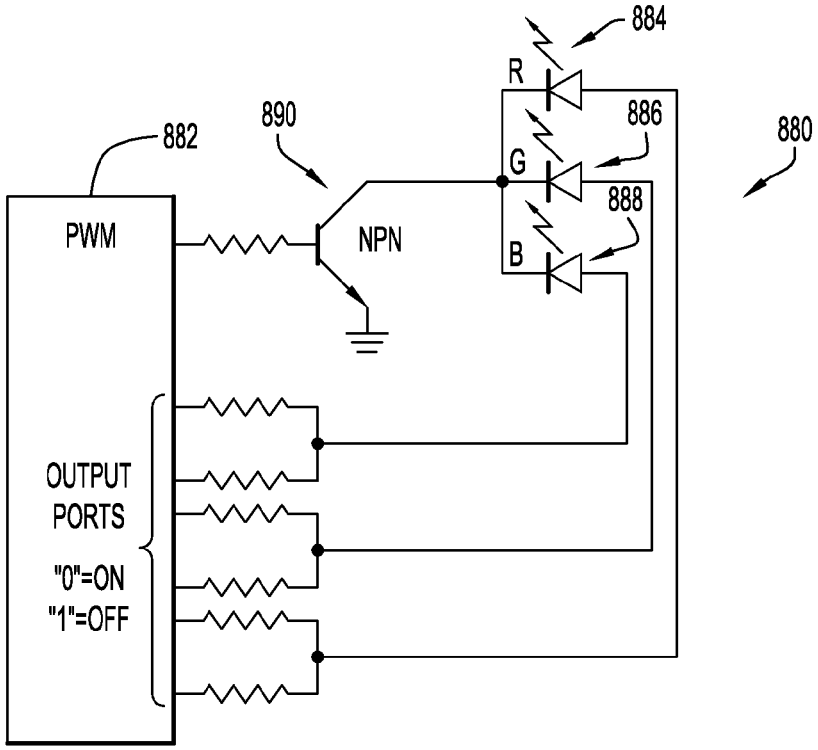

In FIG. 30, a schematic view of another embodiment of some components of an exemplary electronic system that can be used with a doll according to the present invention is illustrated. In this embodiment, the system 850 has a controller 852 with multiple ports can be used to control the illumination of different LEDs 854, 856, and 858, which are red, green, and blue, respectively. FIG. 31 illustrates a schematic view of another system 880 which includes a controller 882 with multiple ports to control the illumination of different LEDs 884, 886, and 888, which are red, green, and blue, respectively. The difference between systems 850 and 880 is the configuration of components 860 and 890. The resistor networks that are switched out of the circuit are floated.

Figure 32:
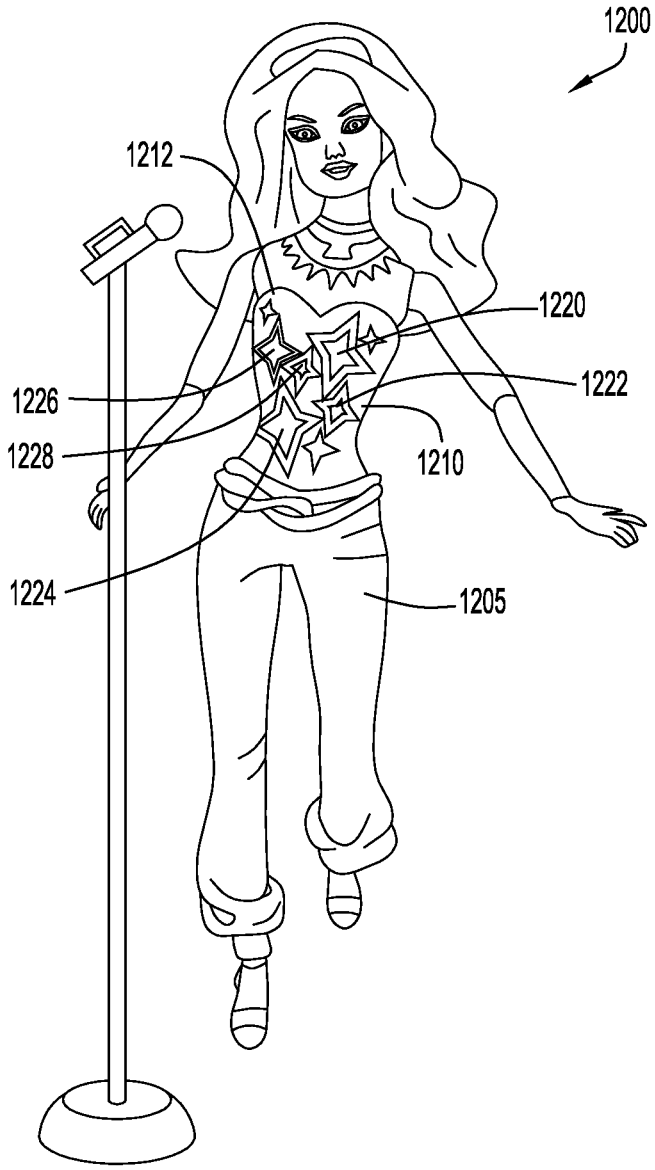
FIGS. 32-34 illustrate front views of alternative embodiments of dolls according to the present invention.

Referring to FIG. 32, an alternative embodiment of a doll according to the present invention is illustrated. In this embodiment, the doll 1200 includes a body 1205 with a torso portion 1210 having a front side 1212. Formed in the front side 1212 of the torso portion 1210 are several openings 1220, 1222, 1224, 1226, and 1228 through which light from LEDs located in the interior region of the torso portion 1210 can be emitted. In this embodiment, the openings are in the form of simple, four-pointed stars. Depending on the particular LED or LEDs that are illuminated, different ones of the openings 1220, 1222, 1224, 1226 and 1228 are illuminated. In this embodiment, some of the openings adjacent to each other may be illuminated by a single LED. For example, openings 1226 and 1228 are proximate to each other and share a single LED.

Figure 33:
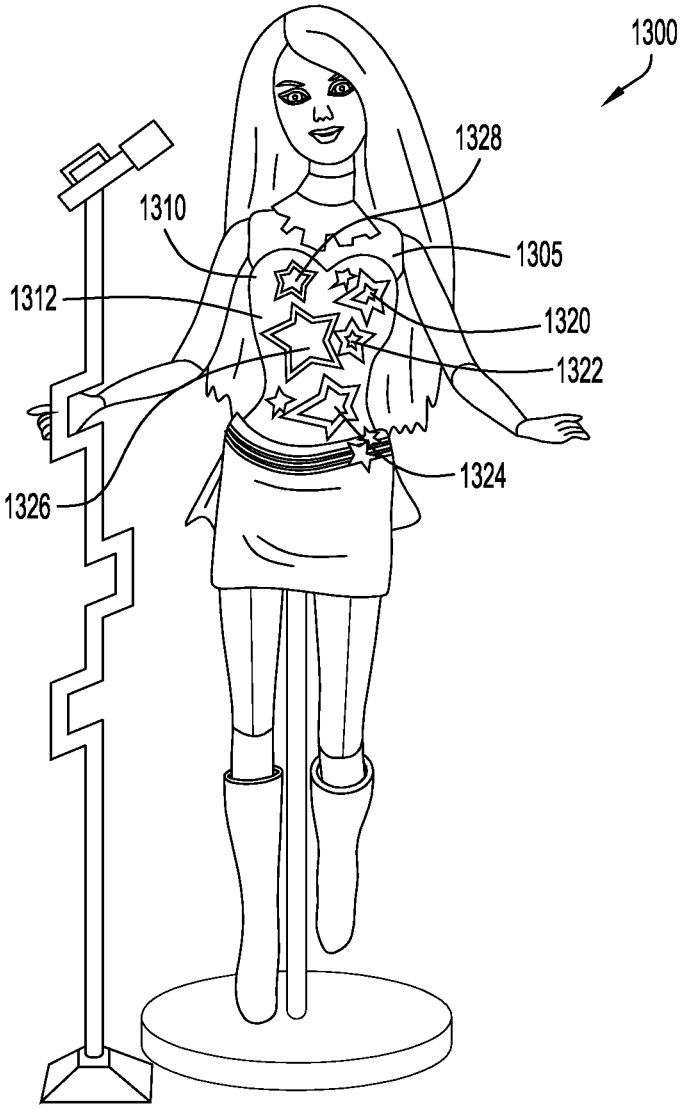

Referring to FIG. 33, an alternative embodiment of a doll according to the present invention is illustrated. In this embodiment, the doll 1300 includes a body 1305 with a torso portion 1310 having a front side 1312. Formed in the front side 1312 of the torso portion 1310 are several openings 1320, 1322, 1324, 1326, and 1328 through which light from LEDs located in the interior region of the torso portion 1310 can be emitted. In this embodiment, the openings are in the form of five-pointed stars. Depending on the particular LED or LEDs that are illuminated, different ones of the openings 1320, 1322, 1324, 1326 and 1328 are illuminated and in one embodiment, openings 1322 and 1326 are illuminated by a single LED.

Figure 34:
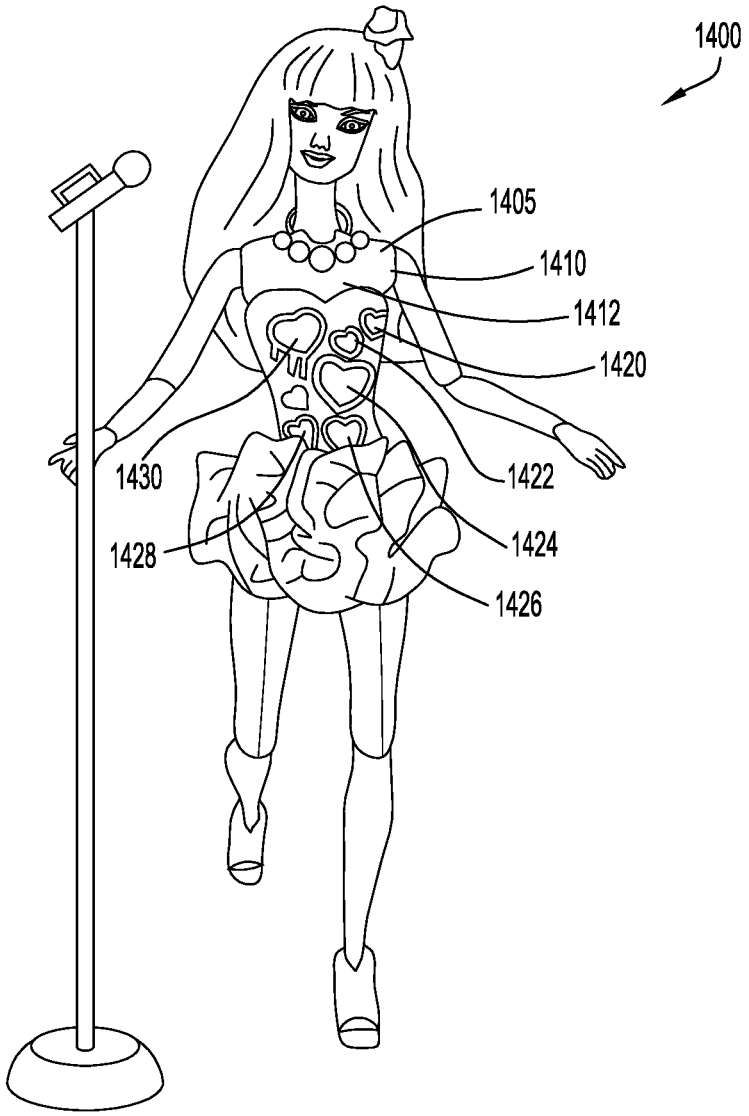

Referring to FIG. 34, an alternative embodiment of a doll according to the present invention is illustrated. In this embodiment, the doll 1400 includes a body 1405 with a torso portion 1410 having a front side 1412. Formed in the front side 1412 of the torso portion 1410 are several openings 1420, 1422, 1424, 1426, and 1430 through which light from LEDs located in the interior region of the torso portion 1410 can be emitted. In this embodiment, the openings are in the form of hearts. Depending on the particular LED or LEDs that are illuminated, different ones of the openings 1420, 1422, 1424, 1426, and 1430 are illuminated. In this embodiment, some of the openings adjacent to each other may be illuminated by a single LED. The doll 1400 includes an actuator 1428 disposed on the torso portion 1410 that can be pressed or engaged by a user to activate the electronic system of the doll 1400.

Figure 35:
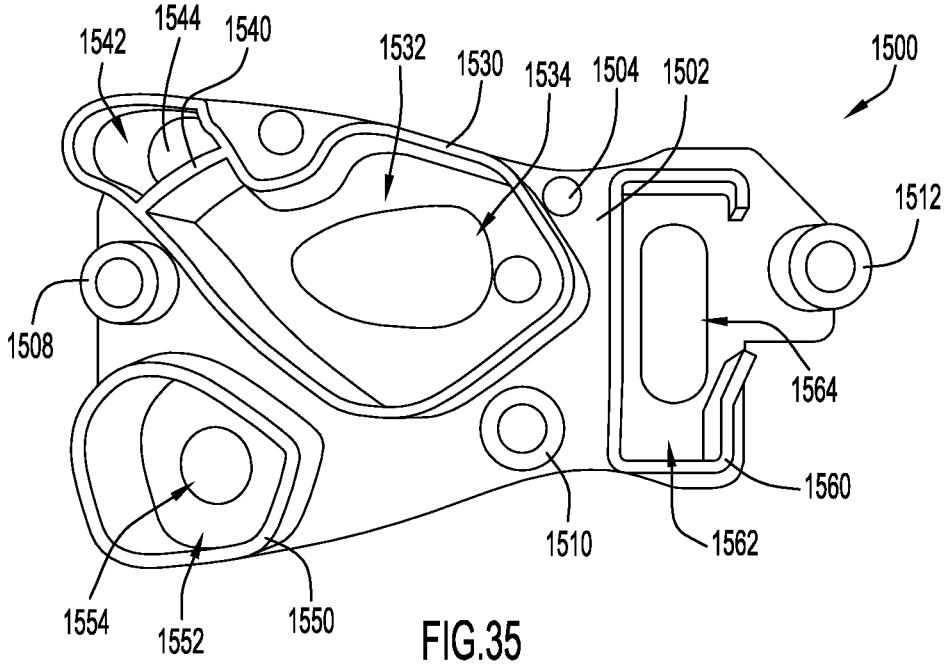
FIG. 35 illustrates a top view of a guide structure of the doll illustrated in FIG. 34.
Figure 36:
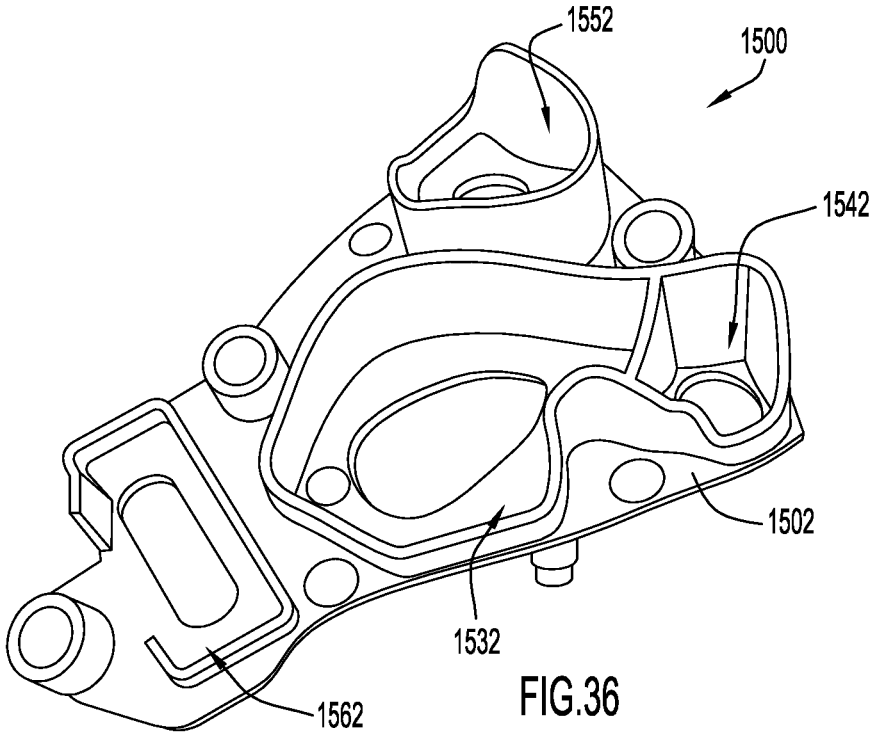
FIG. 36 illustrates a top perspective view of the guide structure illustrated in FIG. 35.
Figure 37:
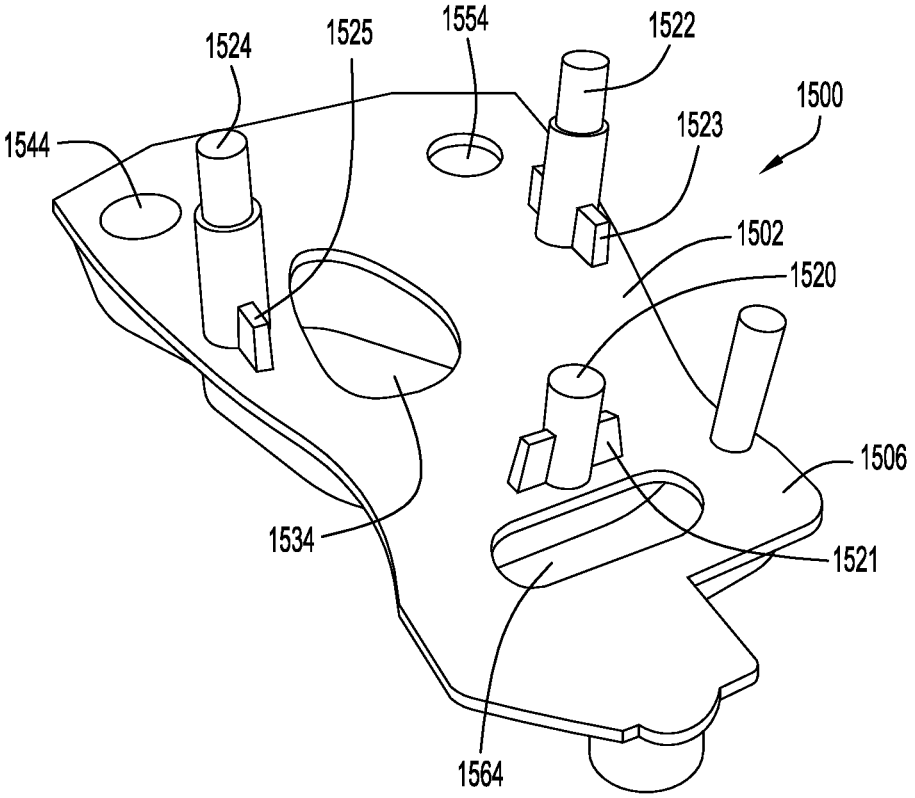
FIG. 37 illustrates a bottom perspective view of the guide structure illustrated in FIG. 35.

Referring to FIGS. 35-37, an embodiment of a guide structure used with doll 1400 is illustrated. The receptacles in the guide structure function as separate light cups. In this embodiment, the guide structure 1500 includes a base plate 1502 with an upper or outer surface 1504 (see FIG. 35) and a lower or inner surface 1506 (see FIG. 37). The base plate 1502 includes several mounting elements 1508, 1510, and 1512 that are spaced apart on the base plate 1502 and that have openings into which connectors, such as posts on an insert member, can be inserted.

In this embodiment, the guide structure 1500 has several spaced apart receptacles as shown in FIGS. 35 and 36. The guide structure 1500 includes walls 1530 and 1540 that collectively define receptacles 1532 and 1542, as shown. Receptacle 1532 is in communication with an opening 1534 formed in the base plate 1502. In the torso portion of the doll 1400, receptacle 1532 is aligned with openings 1422 and 1424, which share an LED. The receptacle 1532 is sized so that light entering opening 1534 from an LED, such as an LED mounted on a circuit board, exits both of the openings 1422 and 1424. Receptacle 1542 is in communication with an opening 1544 that is formed in the base plate 1502. Receptacle 1542 is aligned with opening 1544 and is sized so that light entering opening 1544 from an LED exits opening 1420 in the doll body.

The guide structure 1500 also includes a wall 1550 that defines receptacle 1552 that is in communication with an opening 1554 formed in the base plate 1502. Receptacle 1552 is aligned with opening 1430 in the torso portion of the doll 1400 and is sized so that light entering opening 1554 from an LED exits opening 1430. In addition, the guide structure 1500 includes a wall 1560 that defines a receptacle 1562 that is in communication with another opening 1564 formed in the base plate 1502. Receptacle 1562 is aligned with openings 1426 and 1428 in the torso portion of the doll 1400 and is sized so that light entering opening 1564 from an LED exits openings 1426 and 1428.

Referring to FIG. 37, a perspective view of the bottom of the guide structure 1500 is illustrated. The openings 1534, 1544, 1554, and 1564 are formed in the base plate 1502 and extend therethrough. Extending from the lower surface 1506 of the base plate 1502 are several mounting elements that are used to mount the guide structure 1500 to a circuit board in the same manner as discussed above for the guide structure 1140 and circuit board 1200. The mounting elements include posts 1520, 1522, and 1524 that extend from the lower surface 1506. The posts 1520, 1522, and 1524 include teeth 1521, 1523, and 1525, respectively, that are used to engage a surface of a circuit board to maintain the lower surface 1506 of the guide structure 1500 in a spaced apart position relative to the surface of the circuit board.

Figure 38:
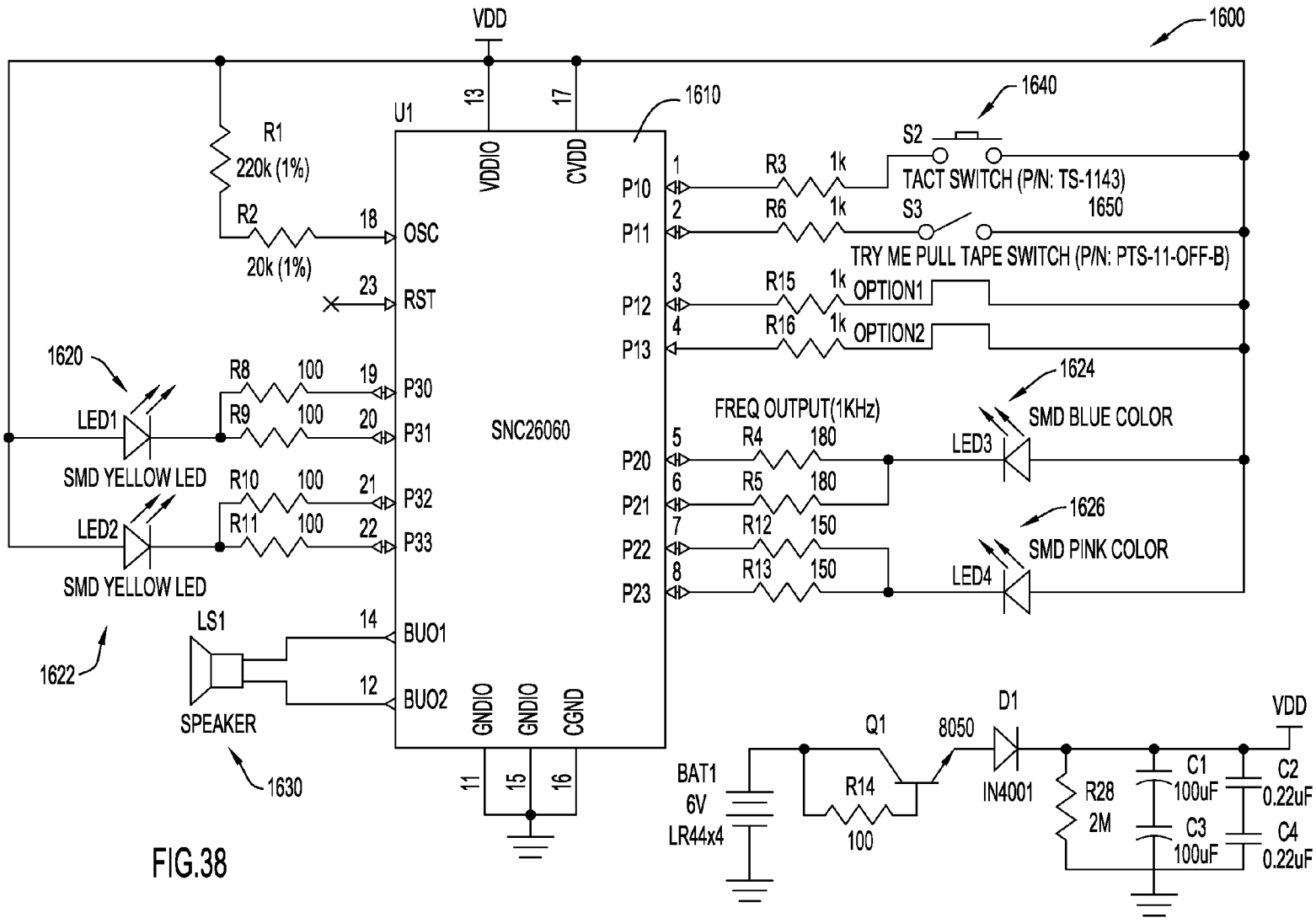
FIG. 38 illustrates a schematic diagram of an electronic system for use with the dolls illustrated in FIGS. 32-34.

Referring to FIG. 38, a schematic showing an embodiment of a circuit of an electronic system for dolls 1200, 1300, and 1400 is illustrated. In this embodiment, the circuit 1600 includes a controller 1610 and several LEDs 1620, 1622, 1624, and 1626. In one embodiment, LEDs 1620 and 1622 are yellow LEDs, LED 1624 is blue, and LED 1626 is pink. As discussed above, in one embodiment, guide structure 1500 includes four openings 1534, 1544, 1554, and 1564. Each of the LEDs 1620, 1622, 1624, and 1626 is associated and aligned with one of the openings 1534, 1544, 1554, and 1564 in the guide structure 1500.

The circuit 1600 includes a speaker 1630 that is used to generate audible outputs from the doll. The circuit 1600 also includes a switch 1640 that corresponds to an actuator of the doll. When a user presses or engages the actuator of the doll, the switch 1640 is closed. In this embodiment, the circuit 1600 includes a "try me" switch 1650 that facilitates the testing or trying of the doll when in packaging in a store.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments.

What is claimed is:

1. A reconfigurable doll, comprising:

a body having a torso portion, an output generating system, and an actuator coupled to the body and connected to the output generating system; and a clothing article coupled to the body, the clothing article has an upper portion and a lower portion coupled to the upper portion, the clothing article being movable between a first configuration and a second configuration relative to the body, the upper portion of the clothing article covers the torso portion when the clothing article is in its first configuration, and when the clothing article is moved to the second configuration, the upper portion is folded down proximate to the lower portion and the clothing article can be engaged by a user to contact the actuator to cause an output to be generated by the output generating system.

2. The reconfigurable doll of claim 1, wherein the output includes a visual output and an audible output.

3. The reconfigurable doll of claim 1, wherein the output generating system includes at least one light emitting device.

4. The reconfigurable doll of claim 1, wherein the torso portion includes a translucent portion and the output generating system includes a light emitting device, and the light from the light emitting device is visible through the translucent portion.

5. The reconfigurable doll of claim 1, wherein the torso portion includes a front surface with a first translucent portion and a second translucent portion, the output generating system includes a first light emitting device and a second light emitting device, light from the first light emitting device passes through the first translucent portion, and light from the second light emitting device passes through the second translucent portion.

6. The reconfigurable doll of claim 5, wherein the body includes a guide element that defines a first chamber and a second chamber separate from the first chamber, the first chamber is proximate to the first translucent portion, the second chamber is proximate to the second translucent portion, the first light emitting device is located proximate to the first chamber, and the second light emitting device is located proximate to the second chamber.

7. The reconfigurable doll of claim 5, wherein the first light emitting device and the second light emitting device can be illuminated at different times.

8. The reconfigurable doll of claim 1, wherein the clothing article has a first surface and a second surface opposite to the first surface, the first surface is oriented outwardly when the clothing article is in its first configuration, and the second surface is oriented outwardly when the clothing article is in its second configuration.

9. The reconfigurable doll of claim 1, wherein the clothing article is rotated approximately 180 degrees about the body to move from the first configuration to the second configuration.

10. The reconfigurable doll of claim 1, wherein the clothing article includes an engagement member coupled thereto, the engagement member is proximate to and configured to contact the actuator when the clothing article is placed in its second configuration.

11. A doll, comprising:

a body defining an interior region, the body including an electronic system that includes an actuator coupled to the body, a first light emitting device and a second light emitting device, each of the light emitting devices is located in the interior region, the body defining a first translucent portion and a second translucent portion separate from the first translucent portion such that light from the first light emitting device passes through the first translucent portion only and light from the second light emitting device passes through the second translucent portion only; and a clothing article coupled to the body, the clothing article being movable between a first configuration and a second configuration, the clothing article in its first configuration covers the translucent portions, and the clothing article in its second configuration is spaced apart from the translucent portions and is configured to engage the actuator, wherein actuation of the actuator results in illumination of the light emitting devices.

12. The doll of claim 11, wherein the body has a torso with a front portion, the translucent portions are formed in the front portion of the torso, and the clothing article covers the torso front portion in the first configuration.

13. The doll of claim 11, wherein the body includes a first chamber and a second chamber having a different size than the first chamber, the first chamber is located so as to direct light from the first light emitting device through the first translucent portion, and the second chamber is located so as to direct light from the second light emitting device through the second translucent portion.

14. A doll with a reconfigurable clothing article, comprising:

a doll body including a torso portion, a leg portion, and an actuator, the torso portion including a translucent portion, the doll body defining an interior region in which a light emitting device is located, the light emitting device being positioned so that light from the light emitting device passes through the translucent portion; and a clothing article coupled to the doll body, the clothing article being reconfigurable between a first configuration and a second configuration, the clothing article in its first configuration covers the translucent portion, and the clothing article in its second configuration is configured to engage the actuator to actuate the light emitting device.

15. The doll of claim 14, wherein the clothing article in the second configuration is spaced apart from the translucent portion so that the translucent portion is visible.

16. The doll of claim 14, wherein the clothing article has a first side and a second side opposite to the first side, the first side is exposed when the clothing article is in its first configuration, and the second side is exposed when the clothing article is in its second configuration, the clothing article is moved approximately 180 degrees relative to the torso portion when the clothing article moves between its first configuration and its second configuration.

17. The doll of claim 14, wherein the translucent portion is a first translucent portion and the light emitting device is a first light emitting device, and the doll body includes a second translucent portion and a second light emitting device, the first light emitting device is located so that light from the first light emitting device only passes through the first translucent portion, and the second light emitting device is located so that light from the second light emitting device only passes through the second translucent portion.

* * * * *